US011234481B2

(12) United States Patent
Seguin et al.

(10) Patent No.: US 11,234,481 B2
(45) Date of Patent: Feb. 1, 2022

(54) SKATE

(71) Applicant: BAUER HOCKEY LTD., Blainville (CA)

(72) Inventors: Alexis Seguin, Laval (CA); Jason Clarke, Ottawa (CA); Raymond Boissonneault, St-Hippolyte (CA)

(73) Assignee: BAUER HOCKEY LLC, Exeter, NH (US)

( * ) Notice: Subject to any disclaimer, the term of this patent is extended or adjusted under 35 U.S.C. 154(b) by 0 days.

(21) Appl. No.: 16/229,928

(22) Filed: Dec. 21, 2018

(65) Prior Publication Data

US 2019/0191816 A1 Jun. 27, 2019

Related U.S. Application Data

(60) Provisional application No. 62/609,921, filed on Dec. 22, 2017.

(51) Int. Cl.
*A43B 5/16* (2006.01)
*A43B 23/08* (2006.01)

(52) U.S. Cl.
CPC ..... *A43B 5/1683* (2013.01); *A43B 5/1641* (2013.01); *A43B 23/081* (2013.01)

(58) Field of Classification Search
CPC ... A43B 23/086; A43B 23/087; A43B 23/081; A43B 5/1683; A43B 5/1641; A43B 5/16; A43B 5/1608; A43B 5/1666; A43B 5/1675; A43B 5/1691
USPC ..... 36/77 R
See application file for complete search history.

(56) References Cited

U.S. PATENT DOCUMENTS 3,292,940 A * 12/1966 Weitzner ..... A43B 5/1633 280/7.13
4,735,003 A * 4/1988 Dykeman ..... A43B 23/087 36/77 R
4,988,122 A * 1/1991 Saunders ..... A63C 3/00 280/11.12
5,210,963 A * 5/1993 Harwood ..... A43B 23/086 36/72 R
D784,665 S * 4/2017 Yeh ..... D2/946
2004/0009337 A1* 1/2004 Tanaka ..... A43B 23/087 428/292.1
2007/0068044 A1* 3/2007 Ikegami ..... A43B 23/087 36/77 R
2012/0011742 A1* 1/2012 Yang ..... A43B 23/081 36/45
2012/0167418 A1* 7/2012 Frappier ..... A43B 7/085 36/115
2013/0119580 A1* 5/2013 Yang ..... A43B 5/1666 264/279
2013/0255111 A1* 10/2013 Sakurai ..... A43B 23/082 36/77 R
2014/0259794 A1* 9/2014 Labonte ..... A43B 5/16 36/115

(Continued)

*Primary Examiner* — Ted Kavanaugh

(57) ABSTRACT

A skate (e.g., an ice skate) for a user (e.g., a hockey player). The skate comprises a skate boot for receiving a foot of the user and a skating device (e.g., a blade and a blade holder) disposed beneath the skate boot to engage a skating surface. The skate boot may be designed to better fit the user's foot and/or enhance skating performance of the user, such as by being shaped in accordance with anatomy of toes of the user's foot and/or enhancing integrity of the skate boot.

44 Claims, 21 Drawing Sheets

(56) References Cited

U.S. PATENT DOCUMENTS

| | | | | |
|---|---|---|---|---|
| 2015/0047227 | A1* | 2/2015 | Fallon | A43B 23/17<br>36/88 |
| 2017/0080323 | A1* | 3/2017 | Dubois | A43B 5/1625 |

* cited by examiner

SKATE

CROSS-REFERENCE TO RELATED APPLICATIONS

This application claims priority from U.S. Provisional Patent Application 62/609,921 filed on Dec. 22, 2017 and incorporated by reference herein.

FIELD

This disclosure generally relates to skates (e.g., ice skates), such as for playing hockey and/or for other activities.

BACKGROUND

Skates are used by users in various sports such as ice hockey, roller hockey, etc., and other skating activities.

A skate comprises a skate boot that may comprise a number of components that are assembled together, such as a body (e.g., a shell), a toe cap, facings, a tongue, a tendon guard, etc. While various designs have been contemplated for some of these components such as the skate boot's body for fit and comfort of a user's foot or to improve skating performance, others of these components such as the toe cap or the facings may sometimes present issues.

For these and/or other reasons, there is a need for improvements directed to skates including their skate boots.

SUMMARY

In accordance with various aspects, this disclosure relates to a skate (e.g., an ice skate) for a user (e.g., a hockey player) that comprises a skate boot for receiving a foot of the user and a skating device (e.g., a blade and a blade holder) disposed beneath the skate boot to engage a skating surface, in which the skate boot may be designed to better fit the user's foot and/or enhance skating performance of the user, such as by being shaped in accordance with anatomy of toes of the user's foot and/or enhancing integrity of the skate boot.

For example, in accordance with an aspect, this disclosure relates to a skate boot for a skate. The skate boot defines a cavity to receive a foot of a user. The skate boot comprises an ankle portion configured to receive an ankle of the user, a heel portion configured to receive a heel of the user's foot, a medial side portion configured to face a medial side of the user's foot, a lateral side portion configured to face a lateral side of the user's foot, a sole portion configured to face a plantar surface of the user's foot and a toe portion that comprises an internal void to receive toes of the user's foot, which include a big toe, an index toe, a middle toe, a ring toe, and a little toe. A medial region of the internal void of the toe portion configured to receive the big toe of the user's foot is larger than a lateral region of the internal void of the toe portion configured to receive the little toe of the user's foot.

In accordance with another aspect, this disclosure relates to a skate boot for a skate. The skate boot defines a cavity to receive a foot of a user. The skate boot comprises an ankle portion configured to receive an ankle of the user, a heel portion configured to receive a heel of the user's foot, a medial side portion configured to face a medial side of the user's foot, a lateral side portion configured to face a lateral side of the user's foot, a sole portion configured to face a plantar surface of the user's foot and a toe portion that comprises an internal void to receive toes of the user's foot, which include a big toe, an index toe, a middle toe, a ring toe, and a little toe. A medial region of the internal void of the toe portion configured to receive the big toe of the user's foot is larger than a lateral region of the internal void of the toe portion configured to receive the little toe of the user's foot. A height of the internal void of the toe portion decreases from the medial region of the internal void of the toe portion to the lateral region of the internal void of the toe portion.

In accordance with another aspect, this disclosure relates to a skate boot for a skate. The skate boot defines a cavity to receive a foot of a user. The skate boot comprises an ankle portion configured to receive an ankle of the user, a heel portion configured to receive a heel of the user's foot, a medial side portion configured to face a medial side of the user's foot, a lateral side portion configured to face a lateral side of the user's foot, a sole portion configured to face a plantar surface of the user's foot and a toe portion that comprises an internal void to receive toes of the user's foot, which include a big toe, an index toe, a middle toe, a ring toe, and a little toe. The toe portion comprises a medial part configured to receive the big toe of the user's foot and a lateral part configured to receive the little toe of the user's foot. A periphery of the toe portion is shaped such that the medial part of the toe portion is taller than the lateral part of the toe portion.

In accordance with another aspect, this disclosure relates to a skate boot for a skate. The skate boot defines a cavity to receive a foot of a user. The skate boot comprises an ankle portion configured to receive an ankle of the user, a heel portion configured to receive a heel of the user's foot, a medial side portion configured to face a medial side of the user's foot, a lateral side portion configured to face a lateral side of the user's foot, a sole portion configured to face a plantar surface of the user's foot and a toe portion that comprises an internal void to receive toes of the user's foot, which include a big toe, an index toe, a middle toe, a ring toe, and a little toe. The toe portion comprises a medial part configured to receive the big toe of the user's foot and a lateral part configured to receive the little toe of the user's foot. The toe portion comprises a proximal part configured to receive proximal ends of the toes of the user's foot and a distal part configured to receive distal ends of the toes of the user's foot. A periphery of the toe portion is shaped such that the medial part of the toe portion is taller than the lateral part of the toe portion and the proximal part of the toe portion is taller than the distal part of the toe portion.

In accordance with another aspect, this disclosure relates to a toe cap for a skate boot of a skate. The skate boot defines a cavity to receive a foot of a user. The toe cap comprises an internal void to receive toes of the user's foot, which include a big toe, an index toe, a middle toe, a ring toe, and a little toe. A medial region of the internal void configured to receive the big toe of the user's foot is larger than a lateral region of the internal void configured to receive the little toe of the user's foot.

In accordance with another aspect, this disclosure relates to a toe cap for a skate boot of a skate. The skate boot defines a cavity to receive a foot of a user. The toe cap comprises an internal void to receive toes of the user's foot, which include a big toe, an index toe, a middle toe, a ring toe, and a little toe. A medial region of the internal void configured to receive the big toe of the user's foot is larger than a lateral region of the internal void configured to receive the little toe of the user's foot. A height of the internal void decreases from the medial region of the internal void to the lateral region of the internal void.

In accordance with another aspect, this disclosure relates to a toe cap for a skate boot of a skate. The skate boot defines a cavity to receive a foot of a user. The toe cap comprises an internal void to receive toes of the user's foot, which include a big toe, an index toe, a middle toe, a ring toe, and a little toe. The toe cap comprises a medial part configured to receive the big toe of the user's foot and a lateral part configured to receive the little toe of the user's foot. A periphery of the toe cap is shaped such that the medial part of the toe cap is taller than the lateral part of the toe cap.

In accordance with another aspect, this disclosure relates to a toe cap for a skate boot of a skate. The skate boot defines a cavity to receive a foot of a user. The toe cap comprises an internal void to receive toes of the user's foot, which include a big toe, an index toe, a middle toe, a ring toe, and a little toe. The toe cap comprises a medial part configured to receive the big toe of the user's foot and a lateral part configured to receive the little toe of the user's foot. The toe cap comprises a proximal part configured to receive proximal ends of the toes of the user's foot and a distal part configured to receive distal ends of the toes of the user's foot. A periphery of the toe cap is shaped such that the medial part of the toe cap is taller than the lateral part of the toe cap and the proximal part of the toe cap is taller than the distal part of the toe cap.

In accordance with another aspect, this disclosure relates to a toe-receiving insert for insertion into a toe portion of a skate boot of a skate. The skate boot defines a cavity to receive a foot of a user. The toe-receiving insert comprises an internal void to receive toes of the user's foot, which include a big toe, an index toe, a middle toe, a ring toe, and a little toe. A medial region of the internal void configured to receive the big toe of the user's foot is larger than a lateral region of the internal void configured to receive the little toe of the user's foot.

In accordance with another aspect, this disclosure relates to a skate boot for a skate. The skate boot defines a cavity to receive a foot of a user. The skate boot comprises a body that comprises an ankle portion configured to receive an ankle of the user, a heel portion configured to receive a heel of the user's foot, a medial side portion configured to face a medial side of the user's foot, and a lateral side portion configured to face a lateral side of the user's foot. The skate boot also comprises a toe cap configured to receive toes of the user's foot and a facing connected to the body of the skate boot and overlapping and secured to the toe cap.

In accordance with another aspect, this disclosure relates to a skate boot for a skate. The skate boot defines a cavity to receive a foot of a user. The skate boot comprises a body that comprises an ankle portion configured to receive an ankle of the user, a heel portion configured to receive a heel of the user's foot, a medial side portion configured to face a medial side of the user's foot, and a lateral side portion configured to face a lateral side of the user's foot. The skate boot also comprises a toe cap configured to receive toes of the user's foot and a facing connected to the body of the skate boot and attached to the toe cap. A given one of the facing and the toe cap comprises a rivet securing the facing and the toe cap together and molded with the given one of the facing and the toe cap.

In accordance with another aspect, this disclosure relates to a skate boot for a skate. The skate boot defines a cavity to receive a foot of a user. The skate boot comprises a body that comprises an ankle portion configured to receive an ankle of the user, a heel portion configured to receive a heel of the user's foot, a medial side portion configured to face a medial side of the user's foot, and a lateral side portion configured to face a lateral side of the user's foot. The skate boot also comprises a facing connected to the body of the skate boot. The facing comprises a wrap-vamping that includes a flex zone to wrap the skate boot on top of the user's foot.

In accordance with another aspect, this disclosure relates to a skate boot for a skate. The skate boot defines a cavity to receive a foot of a user. The skate boot comprises a body that comprises an ankle portion configured to receive an ankle of the user, a heel portion configured to receive a heel of the user's foot, a medial side portion configured to face a medial side of the user's foot, and a lateral side portion configured to face a lateral side of the user's foot. The skate boot also comprises a facing connected to the body of the skate boot and a plurality of eyelets for a lace of the skate boot. Each of the eyelets comprises flexible material that is more flexible than adjacent material of the facing to be compressed when the user's foot is flexed.

These and other aspects of this disclosure will now become apparent to those of ordinary skill in the art upon review of a description of embodiments in conjunction with drawings annexed hereto.

BRIEF DESCRIPTION OF DRAWINGS

A detailed description of embodiments is provided below, by way of example only, with reference to drawings annexed hereto, in which.

It is to be expressly understood that the description and drawings are only for purposes of illustration and as an aid to understanding, and are not intended to be limiting.

DETAILED DESCRIPTION OF EMBODIMENTS

Figure 1:
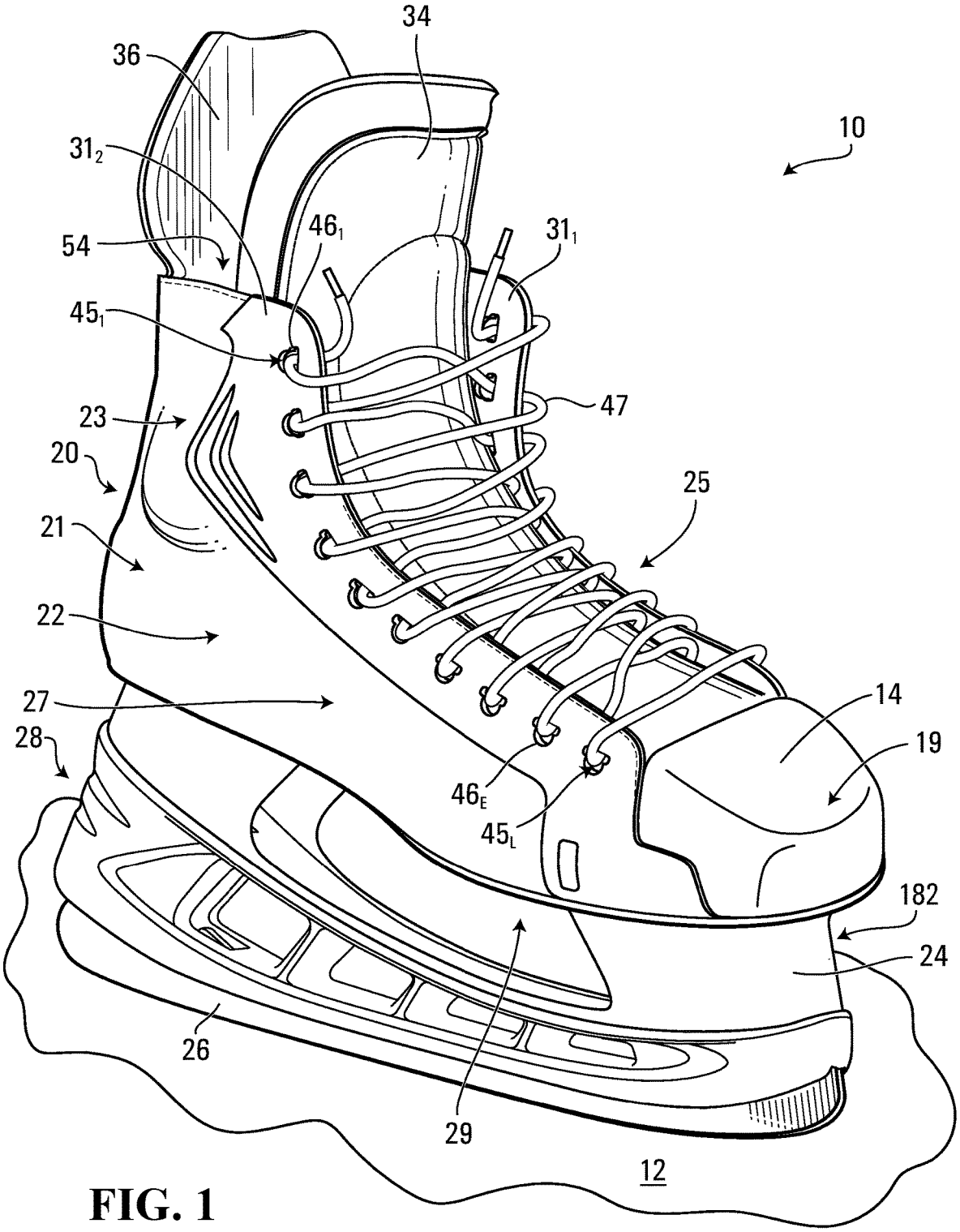
FIG. 1 is an example of an embodiment of a skate for a user.
Figure 2:
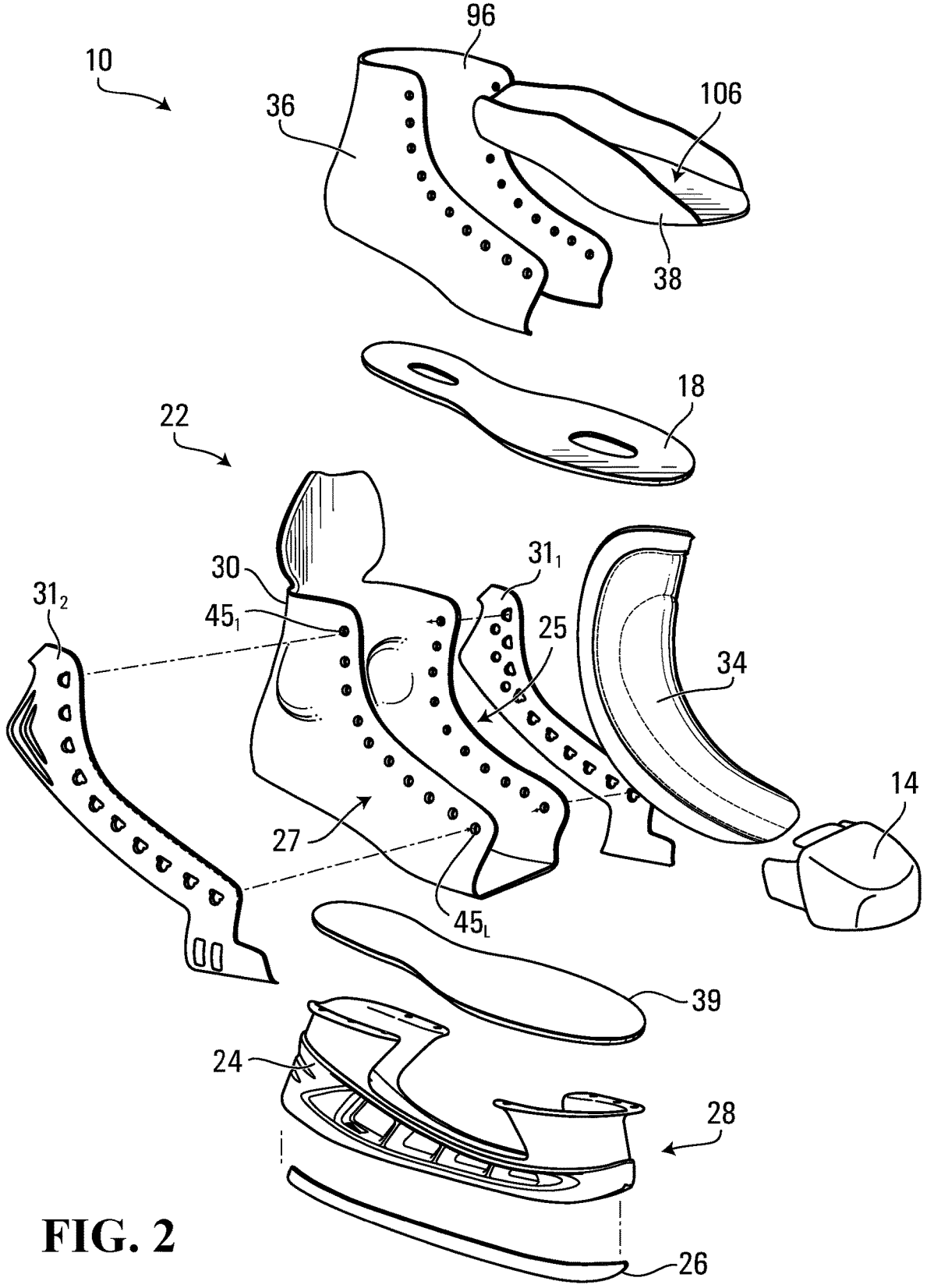
FIG. 2 is an exploded view of the skate.
Figure 3:
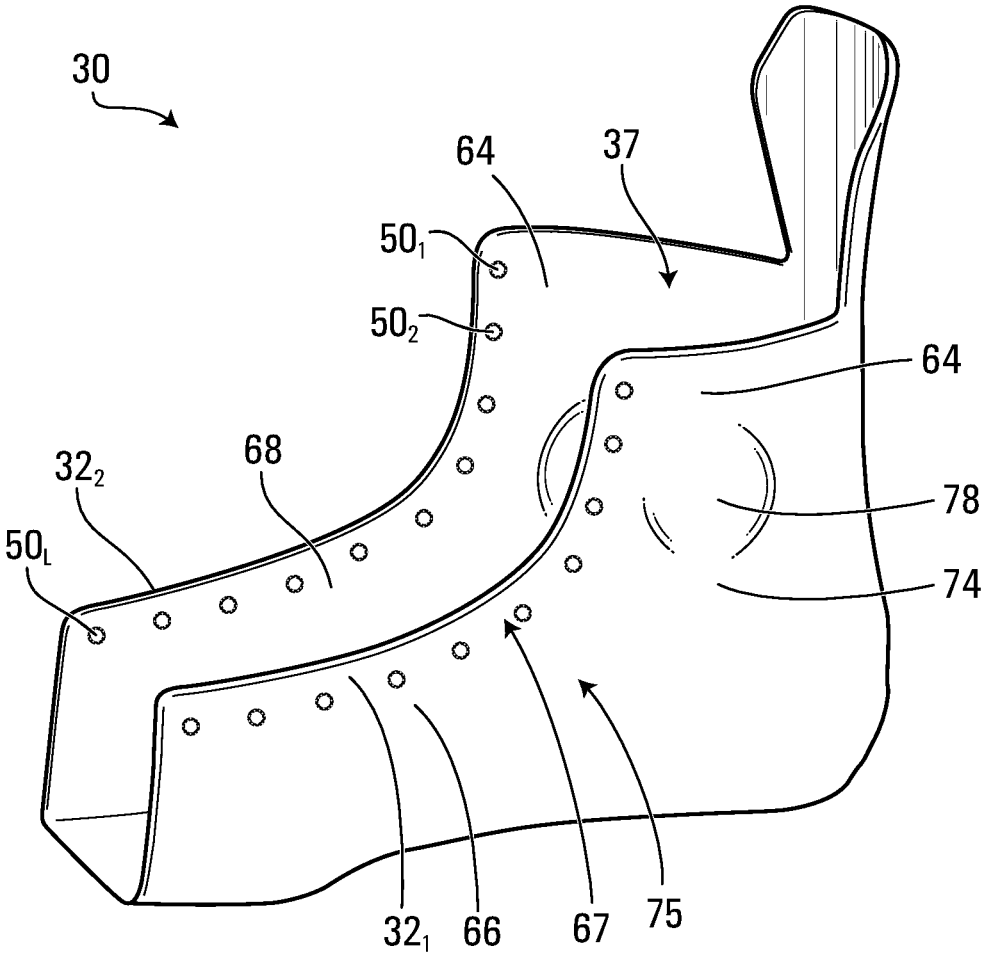
FIGS. 3 to 5 are perspective views of a body of a skate boot of the skate.
Figure 4:
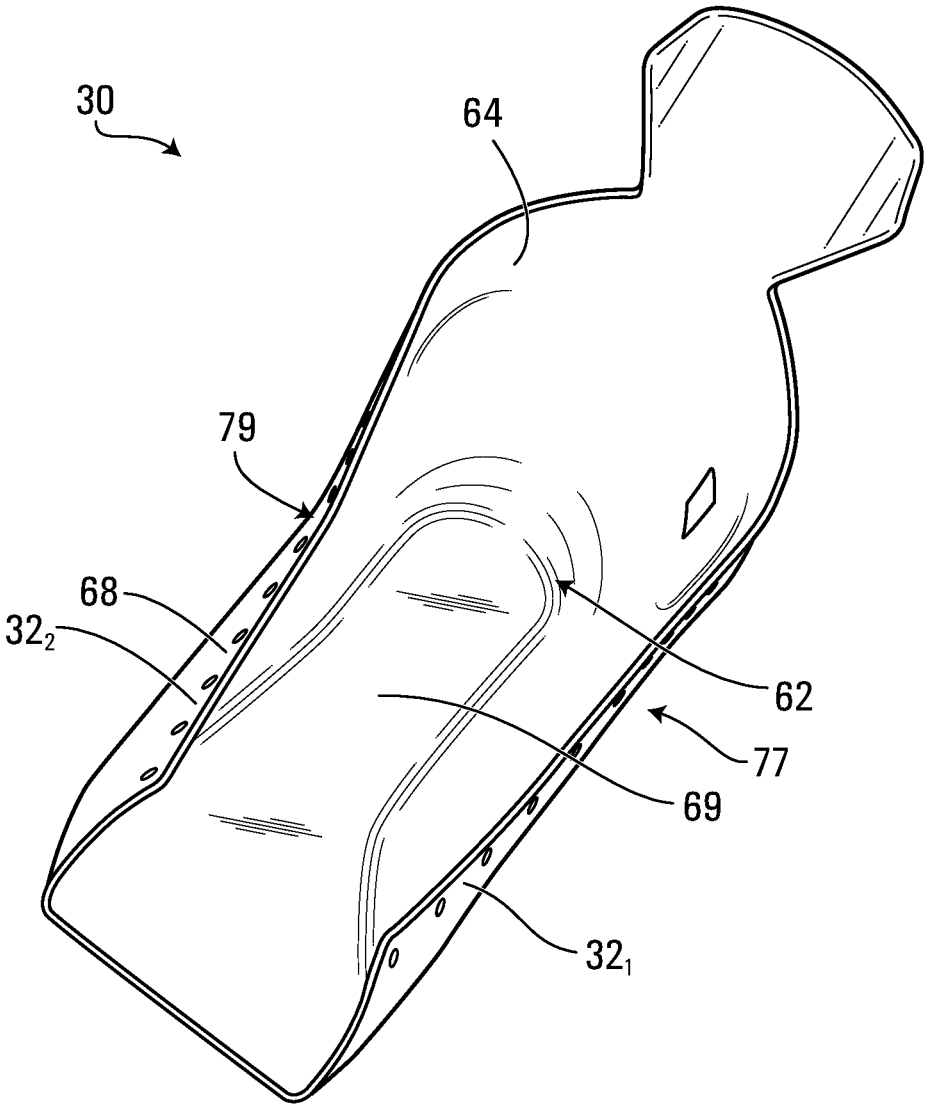
Figure 5:
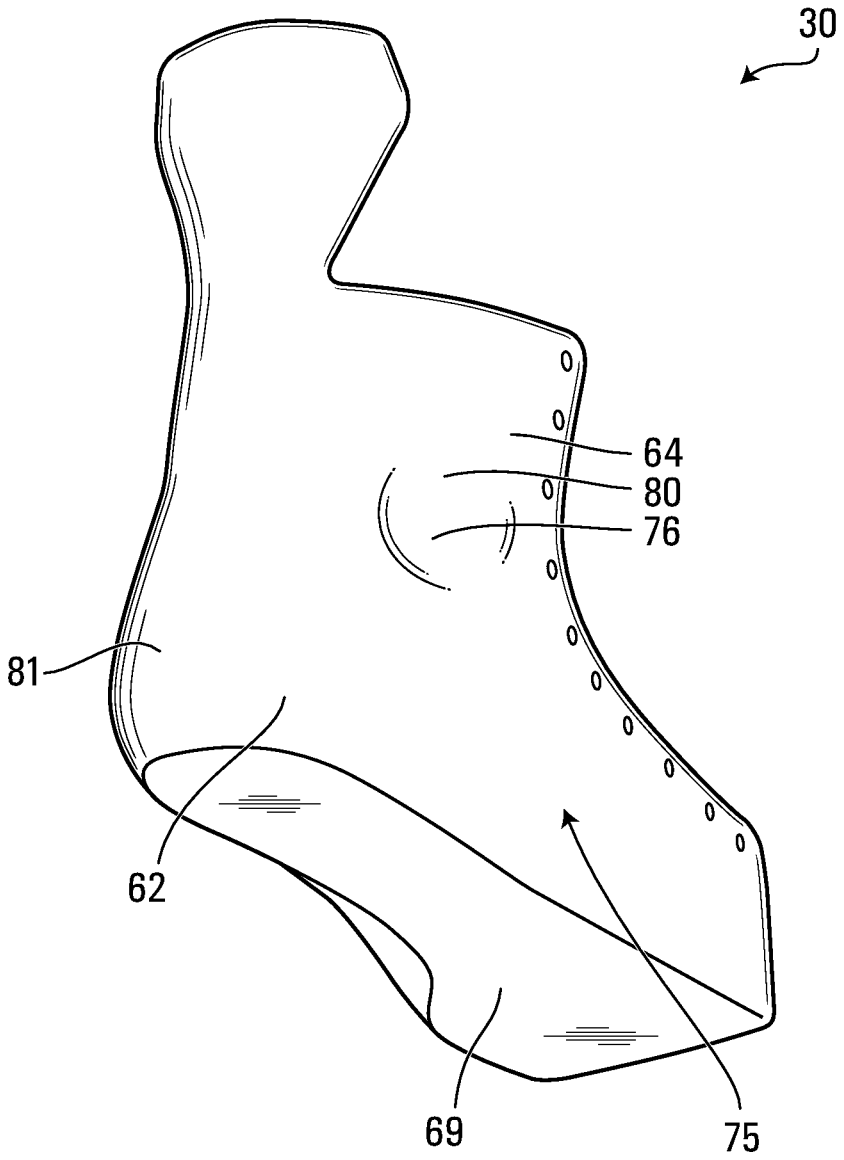
Figure 6:
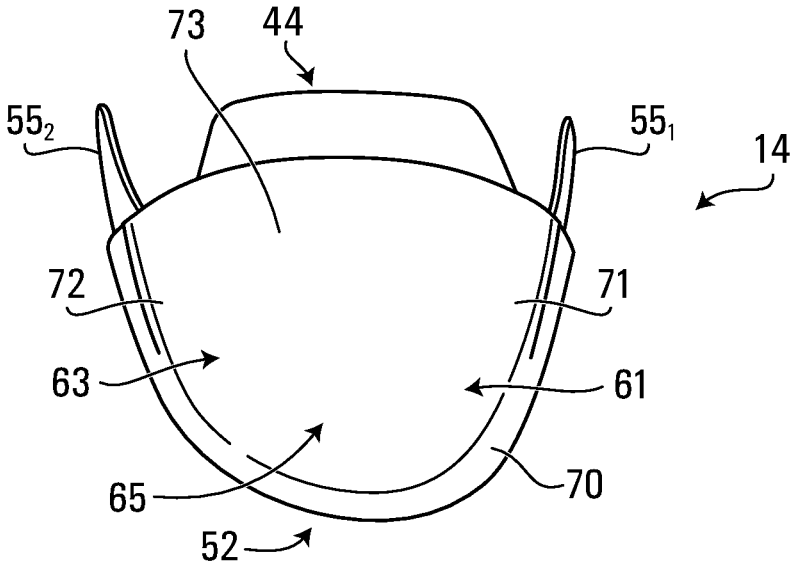
FIGS. 6 to 10 show different views of a toe cap of the skate boot.

FIG. 1 shows an example of an embodiment of a skate 10 for a user to skate on a skating surface 12. In this embodiment, the skate 10 is a hockey skate for the user who is a hockey player playing hockey. In this example, the skate 10 is an ice skate, a type of hockey played is ice hockey, and the skating surface 12 is ice.

The skate 10 comprises a skate boot 22 for receiving a foot 11 of the player and a skating device 28 disposed beneath the skate boot 22 to engage the skating surface 12. In this embodiment, the skating device 28 comprises a blade 26 for contacting the ice 12 and a blade holder 24 between the skate boot 22 and the blade 26. The skate 10 has a longitudinal direction, a widthwise direction, and a heightwise direction.

Figure 32:
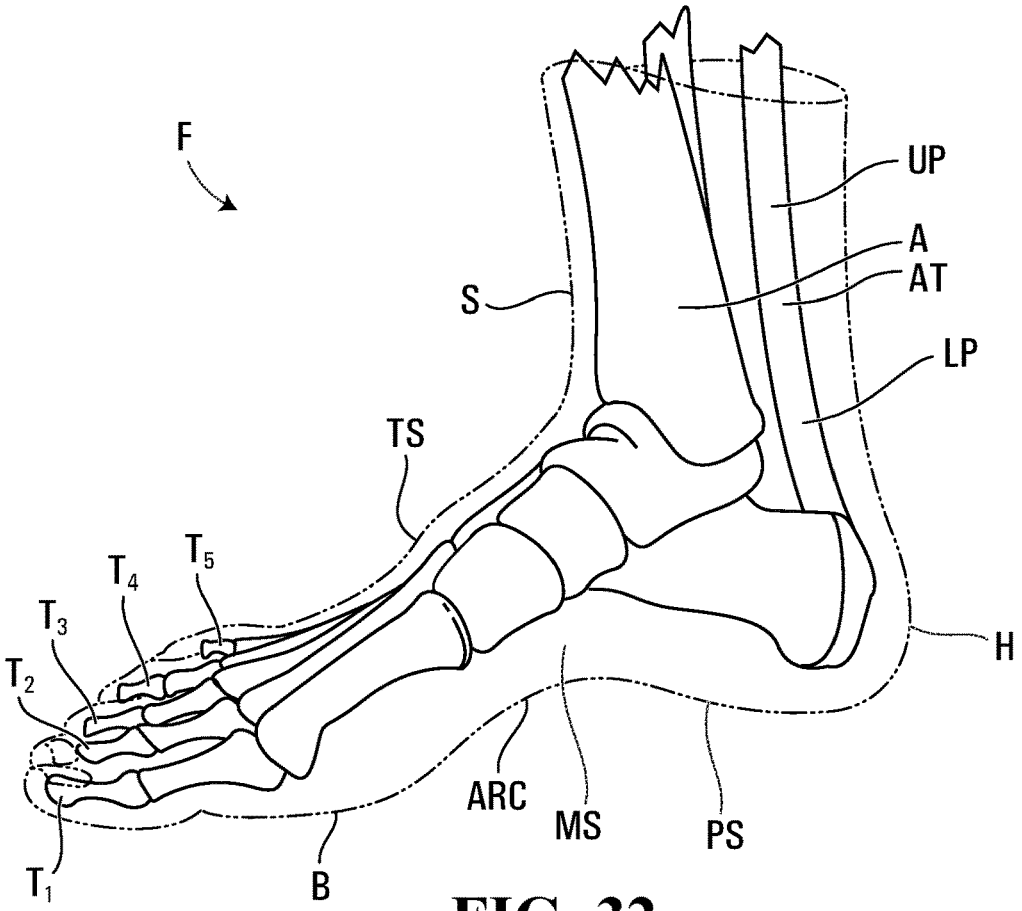
FIGS. 32 and 33 are side and front views of a right foot of the user with an integument of the foot shown in dotted lines and bones shown in solid lines.
Figure 33:
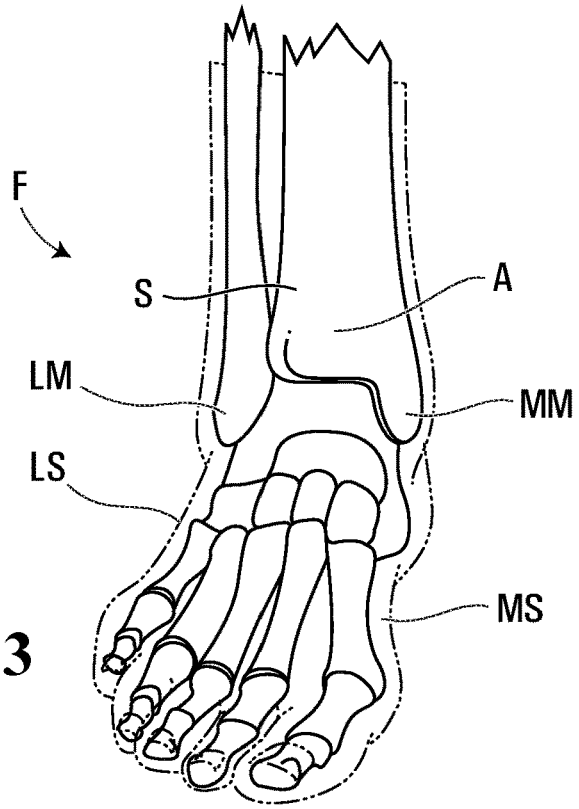

The skate boot 22 defines a cavity 54 for receiving the player's foot 11. With additional reference to FIGS. 32 and 33 the player's foot 11 comprises toes, which include a big toe $T_1$ (i.e., hallux or innermost toe), an index toe $T_2$ (i.e., long toe), a middle toe $T_3$, a ring toe $T_4$, and a little toe $T_5$ (i.e., outermost toe), a ball B, an arch ARC, a plantar surface PS, a top surface TS including an instep IN, a medial side MS, a lateral side LS, and a heel HL. The top surface TS of the player's foot 11 is continuous with a lower portion of a shin S of the player. In addition, the player has an Achilles tendon AT and an ankle A having a medial malleolus MM and a lateral malleolus LM that is at a lower position than the medial malleolus MM. The Achilles tendon AT has an upper part UP and a lower part LP projecting outwardly with relation to the upper part UP and merging with the heel HL. A forefoot of the player includes the toes T and the ball B, a hindfoot of the player includes the heel HL, and a midfoot of the player is between the forefoot and the hindfoot.

In this embodiment, as further discussed below, the skate boot 22 may be designed to better fit the player's foot and/or enhance skating performance of the player, such as by being shaped in accordance with anatomy of the toes $T_1$-$T_5$ of the player's foot and/or enhancing integrity of the skate boot 22.

The skate boot 22 comprises a heel portion 21 configured to face the heel HL of the player's foot, an ankle portion 23 configured to face the ankle A of the player, a medial side portion 25 configured to face the medial side MS of the player's foot, a lateral side portion 27 configured to face the lateral side LS of the player's foot, a sole portion 29 configured to face the plantar surface PS of the player's foot, a toe portion 19 configured to receive the toes $T_1$-$T_5$ of the user's foot, and a tendon guard portion 20 configured to face the upper part UP of the Achilles tendon AT of the player. The skate boot 22 has a longitudinal direction, a widthwise direction, and a heightwise direction.

In this embodiment, with additional reference to FIGS. 2 to 5, the skate boot 22 comprises a body 30 and a plurality of components connected to the body 30, which, in this example, includes facings $\mathbf{31}_1$, $\mathbf{31}_2$, a toe cap 14, a tongue 34, a liner 36, an insole 18, a footbed 38, and an outsole 39. Lacing holes $\mathbf{45}_1$-$\mathbf{45}_L$ extend through each of the facings $\mathbf{31}_1$, $\mathbf{31}_2$, the body 30, and the liner 36 to receive a lace 47 for securing the skate 10 to the player's foot. In this example, eyelets $\mathbf{46}_1$-$\mathbf{46}_E$ are provided in respective ones of the lacing holes $\mathbf{45}_1$-$\mathbf{45}_L$ to engage the lace 47.

The body 30 of the skate boot 22, which may sometimes be referred to as a "shell", imparts strength and structural integrity to the skate 10 to support the player's foot. In this embodiment, the body 30 comprises medial and lateral side portions 66, 68 respectively configured to face the medial and lateral sides MS, LS of the player's foot, an ankle portion 64 configured to face the ankle A of the player, and a heel portion 62 configured to face the heel HL of the player. The medial and lateral side portions 66, 68, the ankle portion 64, and the heel portion 62 of the body 30 respectively constitute at least part (i.e., part or an entirety) of the medial and lateral side portions 25, 27, the ankle portion 23, and the heel portion 21 of the skate boot 22. The body 30 thus includes a quarter 75 which comprises a medial quarter part 77, a lateral quarter part 79, and a heel quarter 81. The heel portion 62 may be formed such that it is substantially cup-shaped for following a contour of the heel HL of the player. The ankle portion 64 comprises medial and lateral ankle sides 74, 76. The medial ankle side 74 has a medial depression 78 for receiving the medial malleolus MM of the player and the lateral ankle side 76 has a lateral depression 80 for receiving the lateral malleolus LM of the player. The lateral depression 80 is located slightly lower than the medial depression 78 for conforming to the morphology of the player's foot. In this example, the body 30 also comprises a sole portion 69 configured to face the plantar surface PS of the player's foot and a tendon guard portion 63 configured to face the upper part UP of the Achilles tendon AT of the player. The sole portion 69 and the tendon guard portion 63 of the body 30 respectively constitute at least part of the sole portion 29 and the tendon guard portion 20 of the skate boot 22.

In this embodiment, the body 30 of the skate boot 22 is molded to form its medial and lateral side portions 66, 68, its ankle portion 64, its heel portion 62, and its sole portion 69. For example, in some embodiments, the body 30 may be thermoformed (e.g., onto a male form, i.e., a last) to form its medial and lateral side portions 66, 68, its ankle portion 64, its heel portion 62, and its sole portion 69. As another example, in some embodiments, at least part of the body 30 may be injection molded such that two or more of its medial and lateral side portions 66, 68, its ankle portion 64, its heel portion 62, and its sole portion 69 are injection molded together and integral with one another (i.e., are injection molded together as a single piece). For instance, in some embodiments, the body 30 may be a monolithic body, i.e., a one-piece body, made by injection molding.

The body 30 of the skate boot 22 may include one or more materials making it up. For example, in some embodiments, the body 30 may include one or more polymeric materials, such as polyethylene, polypropylene, polyurethane (PU), ethylene-vinyl acetate (EVA), nylon, polyester, vinyl, polyvinyl chloride, polycarbonate, an ionomer resin (e.g., Surlyn®), styrene-butadiene copolymer (e.g., K-Resin®) etc.), self-reinforced polypropylene composite (e.g., Curv®), and/or any other thermoplastic or thermosetting polymer. Alternatively or additionally, in some embodiments, the body 30 may include one or more composite materials, such as a fiber-matrix composite material comprising fibers disposed in a matrix. For instance, in some embodiments, the body 30 may include a fiber-reinforced plastic (FRP—a.k.a., fiber-reinforced polymer), comprising a polymeric matrix may include any suitable polymeric resin, such as a thermoplastic or thermosetting resin, like epoxy, polyethylene, polypropylene, acrylic, thermoplastic polyurethane (TPU), polyether ether ketone (PEEK) or other polyaryletherketone (PAEK), polyethylene terephthalate (PET), polyvinyl chloride (PVC), poly(methyl methacrylate) (PMMA), polycarbonate, acrylonitrile butadiene styrene (ABS), nylon, polyimide, polysulfone, polyimide-imide, self-reinforcing polyphenylene, polyester, vinyl ester, vinyl ether, polyurethane, cyanate ester, phenolic resin, etc., a hybrid thermosetting-thermoplastic resin, or any other suitable resin, and fibers such as carbon fibers, glass fibers, polymeric fibers such as aramid fibers (e.g., Kevlar fibers), boron fibers, silicon carbide fibers, metallic fibers, ceramic fibers, etc., which may be provided as layers of continuous fibers (e.g. pre-preg (i.e., pre-impregnated) layers of fibers held together by an amount of matrix).

The toe cap 14 is configured to receive the toes $T_1$-$T_5$ of the player's foot. It comprises a medial part 61 configured to receive the big toe $T_1$ of the player's foot, a lateral part 63 configured to receive the little toe $T_5$ of the player's foot, and an intermediate part 65 that is between its medial part 61 and its lateral part 63 and configured to receive the index toe $T_2$, the middle toe $T_3$, and the ring toe $T_4$ of the player's foot. The toe cap 14 comprises a distal part 52 adjacent to distal ends of the toes $T_1$-$T_5$ of the player's foot and a proximal part 44 adjacent to proximal ends of the toes $T_1$-$T_5$ of the player's foot.

A periphery 70 of the toe cap 14 includes a medial surface 71 that is part of the medial portion 61 and adjacent to the big toe $T_1$ of the player's foot, a lateral surface 72 that is part of the lateral portion 63 and adjacent to the little toe $T_5$ of the player's foot, and a top surface 73 that is between the medial surface 71 and the lateral surface 72 and over the toes $T_1$-$T_5$ of the player's foot.

The toe cap 14 comprises an internal void 86 configured to receive the toes $T_1$-$T_5$ of the player's foot and constituting part of the cavity 54 of the skate boot 22. In this embodiment, the internal void 86 of the toe cap 40 is a single hollow space in which all the toes $T_1$-$T_5$ of the player's foot are received. In other embodiments, the internal void 86 of the toe cap 14 may be partitioned into two or more hollow spaces in which respective ones of the toes $T_1$-$T_5$ of the player's foot are received.

In this embodiment, with additional references to FIGS. 6 to 10, the toe cap 14 is morphologically configured to accommodate the toes $T_1$-$T_5$ of the player's foot in accordance with their anatomy, including by providing more internal space in the medial part 61 of the toe cap 14 proximate to the player's big toe $T_1$ than in the lateral part 63 of the toe cap 14 proximate to the player's little toe $T_5$. That is, a medial region 88 of the internal void 86 of the toe cap 14 configured to receive the player's big toe $T_1$ is larger than a lateral region 89 of the internal void 86 of the toe cap 14 configured to receive the player's little toe $T_5$. This may enhance comfort for the player's foot and skating performance of the player by providing a better fit of the skate boot 22. Notably, this reduces an amount of unoccupied (e.g., "negative") space inside the toe cap 14, which may help to reduce potential for sliding or other movement of the $T_1$-$T_5$ of the player's foot and a front of the foot when skating.

The medial region 88 of the internal void 86 of the toe cap 14 proximate to the player's big toe $T_1$ is that region extending for one-quarter of a dimension $W_T$ of the toe cap 14 in the widthwise direction of the skate boot 22 from the medial surface 71 of the toe cap 14, while the lateral region 89 of the internal void 86 of the toe cap 14 proximate to the player's little toe $T_5$ is that region extending for one-fifth of the dimension $W_T$ of the toe cap 14 in the widthwise direction of the skate boot 22 from the lateral surface 72 of the toe cap 14.

More particularly, in this embodiment, a height $H_1$ of the internal void 86 of the toe cap 14 varies in the widthwise direction of the skate boot 22 such that the height $H_1$ of the internal void 86 of the toe cap 14 at the medial region 88 of the internal void 86 of the toe cap 14 proximate to the player's big toe $T_1$ is greater than the height $H_1$ of the internal void 86 of the toe cap 14 at the lateral region 89 of the internal void 86 of the toe cap 14 proximate to the player's little toe $T_5$. For example, in some embodiments, a ratio of the height $H_i$ of the internal void 86 of the toe cap 14 at the medial region 88 of the internal void 86 of the toe cap 14 proximate to the player's big toe $T_1$ over the height $H_i$ of the internal void 86 of the toe cap 14 at the lateral region 89 of the internal void 86 of the toe cap 14 proximate to the player's little toe $T_5$ may be at least 1.1, in some cases at least 1.15, in some cases at least 1.2, in some cases at least 1.3, and in some cases even more (e.g., 1.4 or more). In this example of implementation, the height $H_i$ of the internal void 86 of the toe cap 14 decreases from the medial region 88 of the internal void 86 of the toe cap 14 to the lateral region 89 of the internal void 86 of the toe cap 14.

Also, in this embodiment, a proximal region 33 of the internal void 86 of the toe cap 14 configured to receive the proximal ends of the toes $T_1$-$T_5$ of the player's foot is larger than a distal region 35 of the internal void 86 of the toe cap 14 configured to receive the distal ends of the toes $T_1$-$T_5$ of the player's foot. The proximal region 33 of the internal void 86 of the toe cap 14 is that region extending for one-eighth of a dimension $L_T$ of the toe cap 14 in the longitudinal direction of the skate boot 22 from the proximal part 44 of the toe cap 14, while the distal region 35 of the internal void 86 of the toe cap 14 is that region extending for one-eighth of the dimension $L_T$ of the toe cap 14 in the longitudinal direction of the skate boot 22 from the front end surface 32 of the toe cap 14. That is, the height $H_i$ of the internal void 86 of the toe cap 14 varies in the longitudinal direction of the skate boot 22 such that the height $H_i$ of the internal void 86 of the toe cap 14 at the proximal region 33 of the internal void 86 of the toe cap 14 is greater than the height $H_1$ of the internal void 86 of the toe cap 14 at the distal region 35 of the internal void 86 of the toe cap 14. For example, in some embodiments, a ratio of the height $H_i$ of the internal void 86 of the toe cap 14 at the proximal region 33 of the internal void 86 of the toe cap 14 over the height $H_i$ of the internal void 86 of the toe cap 14 at the distal region 35 of the internal void 86 of the toe cap 14 may be at least 1.1, in some cases at least 1.2, in some cases at least 1.3, in some cases at least 1.4, in some cases at least 1.5, and in some cases even more.

Taking a cross-section of the toe cap 14 in the widthwise direction of the skate boot 22, a cross-sectional area of a medial half $\mathbf{90}_1$ of the internal void 86 of the toe cap 14 is thus greater than a cross-sectional area of a lateral half $\mathbf{90}_2$ of the internal void 86 of the toe cap 14. For example, in some embodiments, a ratio of the cross-sectional area of the medial half $\mathbf{90}_1$ of the internal void 86 of the toe cap 14 over the cross-sectional area of the lateral half $\mathbf{90}_2$ of the internal void 86 of the toe cap 14 may be at least 1.1, in some cases at least 1.2, in some cases at least 1.3, and in some cases even more.

Also, a volume of the medial half $\mathbf{90}_1$ of the internal void 86 of the toe cap 14 is greater than a volume of the lateral half $\mathbf{90}_2$ of the internal void 86 of the toe cap 14. For example, in some embodiments, a ratio of the volume of the medial half $90_1$ of the internal void 86 of the toe cap 14 over the volume of the lateral half $90_2$ of the internal void 86 of the toe cap 14 may be at least 1.1, in some cases at least 1.2, in some cases at least 1.3, and in some cases even more.

In this example, the periphery 70 of the toe cap 14 is also shaped in accordance with the toes $T_1$-$T_5$ of the player's foot such that the medial part 61 of the toe cap 14 adjacent to the big toe $T_1$ of the player's foot is taller than the lateral part 63 of the toe cap 14 adjacent to the little toe $T_5$ of the player's foot and the top surface 73 extends downwardly from the medial part 61 to the lateral part 63. More particularly, in this example, the top surface 73 is slanted downwardly from the medial part 61 to the lateral part 63 of the toe cap 14.

The medial part 61 of the toe cap 14 adjacent to the big toe $T_1$ of the player's foot is that part extending for one-quarter of the dimension $W_T$ of the toe cap 14 in the widthwise direction of the skate boot 22 from the medial surface 71 of the toe cap 14, while the lateral part 63 of the toe cap 14 adjacent to the little toe $T_5$ of the player's foot is that part extending for one-fifth of the dimension $W_T$ of the toe cap 14 in the widthwise direction of the skate boot 22 from the lateral surface 72 of the toe cap 14.

Figure 7:
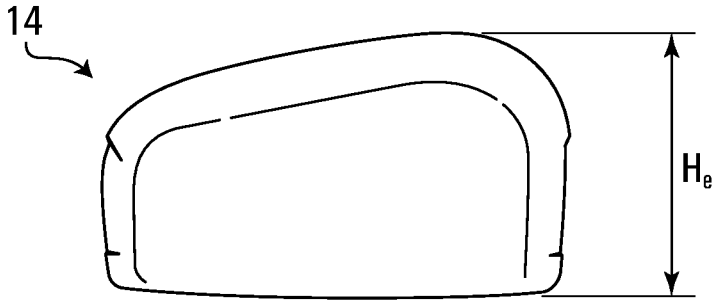
Figure 8:
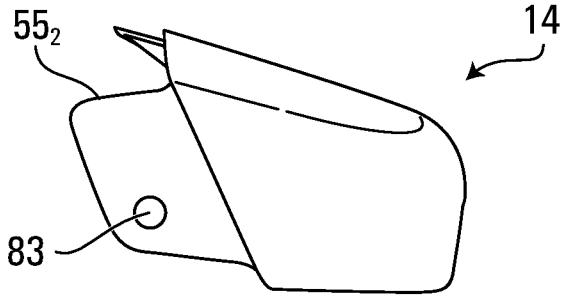
Figure 9:
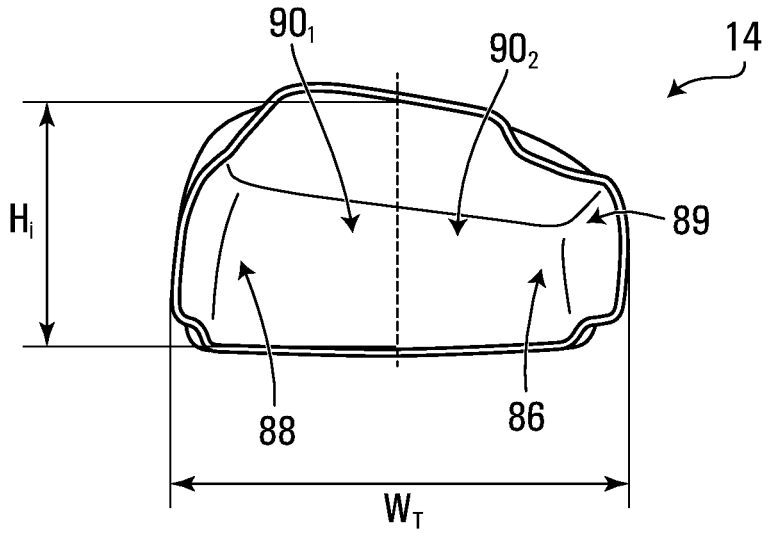
Figure 10:
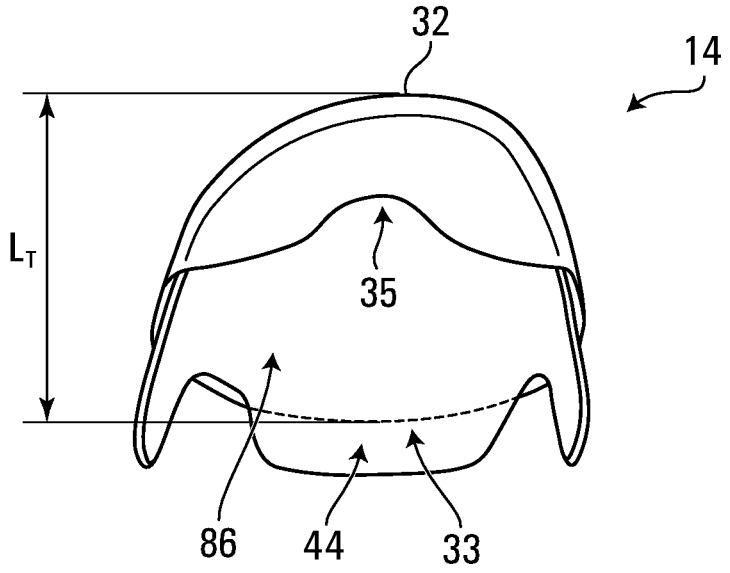

More particularly, in this example, as shown in FIGS. 7 and 8, a height $H_e$ of the periphery 70 of the toe cap 14 varies in the widthwise direction of the skate boot 22 such that the height. $H_e$ of the periphery 70 of the toe cap 14 at the medial part 61 of the toe cap 14 proximate to the player's big toe $T_1$, which defines an apex of the toe cap 14, is greater than the height $H_e$, of the periphery 70 of the toe cap 14 at the lateral part 63 of the toe cap 14 proximate to the player's little toe $T_5$. For example, in some embodiments, a ratio of the height $H_e$ of the periphery 70 of the toe cap 14 at the medial part 61 of the toe cap 14 proximate to the player's big toe $T_1$ over the height $H_e$ of the periphery 70 of the toe cap 14 at the lateral part 63 of the toe cap 14 proximate to the player's little toe $T_5$ may be at least 1.1, in some cases at least 1.15, in some cases at least 1.2, in some cases at least 1.3, and in some cases even more (e.g., 1.4 or more).

Also, in this example, the proximal part 44 adjacent to the proximal ends of the toes $T_1$-$T_5$ of the player's foot is taller than the distal part 52 adjacent to the distal ends of the toes $T_1$-$T_5$ of the player's foot and the top surface 73 extends downwardly from the proximal part 44 to the distal part 52. More particularly, in this example, the top surface 73 is slanted downwardly from the proximal part 44 to the distal part 52 of the toe cap 14.

The proximal part 44 adjacent to the proximal ends of the toes $T_1$-$T_5$ of the player's foot 14 is that region extending for one-eighth of the dimension $L_T$ of the toe cap 14 in the longitudinal direction of the skate boot 22 from the proximal part 44 of the toe cap 14, while the distal part 52 adjacent to the distal ends of the toes $T_1$-$T_5$ of the player's foot is that part extending for one-eighth of the dimension $L_T$ of the toe cap 14 in the longitudinal direction of the skate boot 22 from the front end surface 32 of the toe cap 14.

More particularly, in this example, the height $H_e$ of the periphery 70 of the toe cap 14 varies in the longitudinal direction of the skate boot 22 such that the height $H_e$ of the periphery 70 of the toe cap 14 at the proximal part 44 of the toe cap 14 is greater than the height $H_e$ of the periphery 70 of the toe cap 14 at the distal part 52 of the toe cap 14. For example, in some embodiments, a ratio of the height $H_e$ of the periphery 70 of the toe cap 14 at the proximal part 44 of the toe cap 14 over the height $H_e$ of the periphery 70 of the toe cap 14 at the distal part 52 of the toe cap 14 may be at least 1.1, in some cases at least 1.2, in some cases at least 1.3, in some cases 1.4, and in some cases even more.

The toe cap 14 includes rigid material. For example, in some embodiments, the toe cap 14 may be made of nylon, polycarbonate, polyurethane, polyethylene (e.g., high density polyethylene), or any other suitable thermoplastic or thermosetting polymer. Alternatively or additionally, in some embodiments, the toe cap 14 may include composite material, such as a fiber-matrix composite material comprising fibers disposed in a matrix. For instance, in some embodiments, the toe cap 14 may include a fiber-reinforced plastic (FRP—a.k.a., fiber-reinforced polymer), comprising a polymeric matrix may include any suitable polymeric resin, such as a thermoplastic or thermosetting resin, like epoxy, polyethylene, polypropylene, acrylic, thermoplastic polyurethane (TPU), polyether ether ketone (PEEK) or other polyaryletherketone (PAEK), polyethylene terephthalate (PET), polyvinyl chloride (PVC), poly(methyl methacrylate) (PMMA), polycarbonate, acrylonitrile butadiene styrene (ABS), nylon, polyimide, polysulfone, polyimide-imide, self-reinforcing polyphenylene, polyester, vinyl ester, vinyl ether, polyurethane, cyanate ester, phenolic resin, etc., a hybrid thermosetting-thermoplastic resin, or any other suitable resin, and fibers such as carbon fibers, glass fibers, polymeric fibers such as aramid fibers (e.g., Kevlar fibers), boron fibers, silicon carbide fibers, metallic fibers, ceramic fibers, etc., which may be provided as layers of continuous fibers (e.g. pre-preg (i.e., pre-impregnated) layers of fibers held together by an amount of matrix).

In this embodiment, the toe cap 14 is molded such that a shape of the toe cap 14 is imparted during a molding process in a mold. For instance, in some embodiments, the toe cap 14 may be injection molded. In other embodiments, such as where the toe cap 14 comprises composite material, any other suitable molding (e.g., compression molding) process may be used.

The facings $31_1$, $31_2$ are provided on the medial and lateral side portions 66, 68 of the body 30 of the skate boot 22, including on an external surface 67 of the body 30. In this embodiment, the facings $31_1$, $31_2$ extend respectively along medial and lateral edges $32_1$, $32_2$ of the body 30 from the ankle portion 64 to the medial and lateral side portions 66, 68 towards the toe cap 14.

Figure 11A:
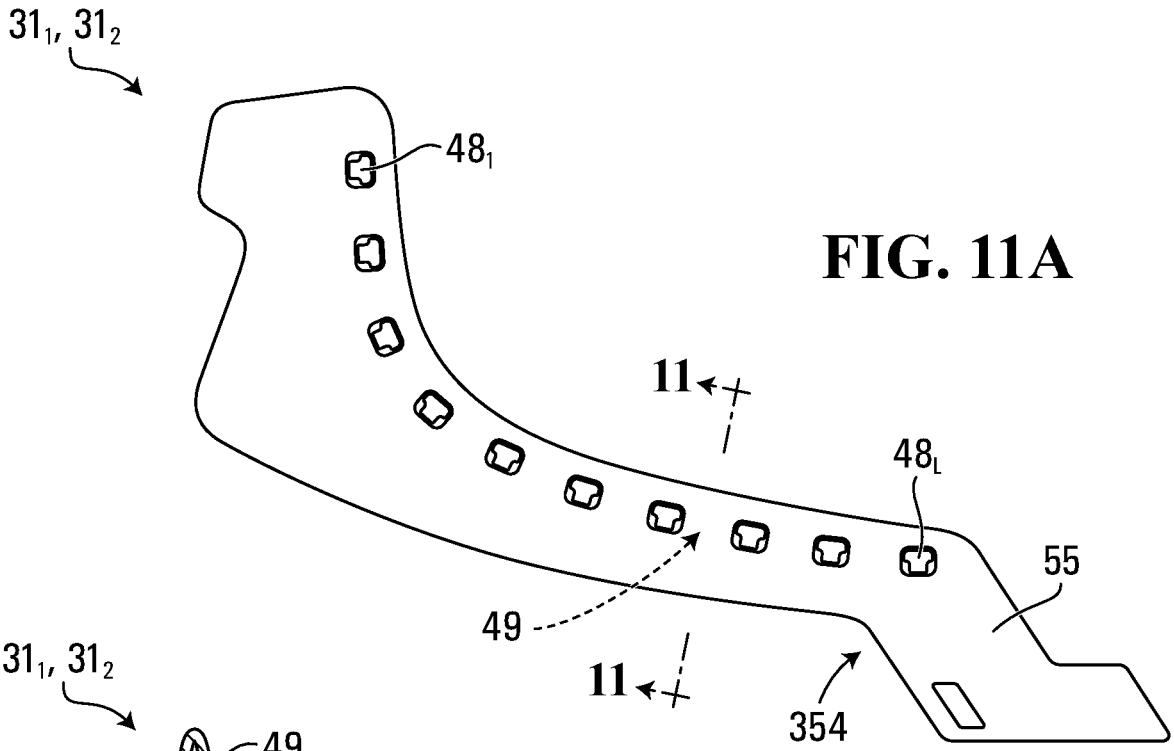
FIG. 11A shows a facing of the skate boot.
Figure 11B:
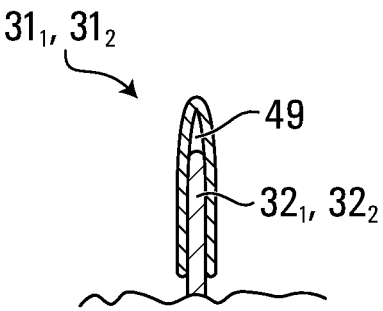
FIG. 11B shows a cross-sectional view of the facing taken along line 11-11 of FIG. 11A.
Figure 12:
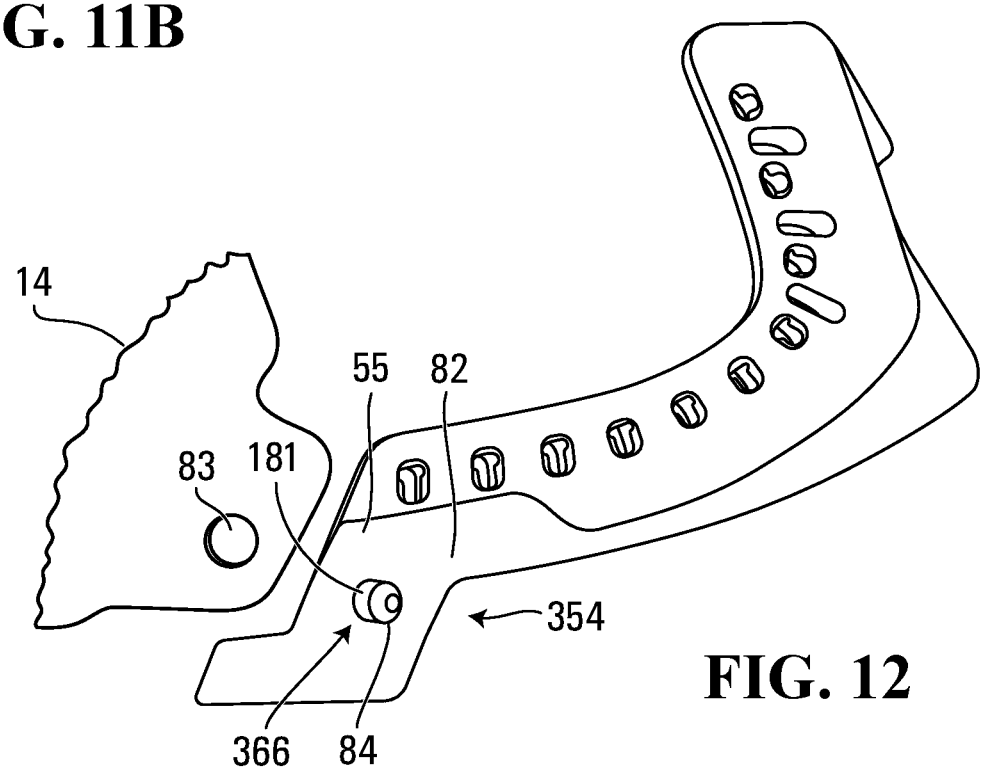
FIGS. 12 to 15 show an attachment of the facing to the toe cap of the skate boot.
Figure 13:
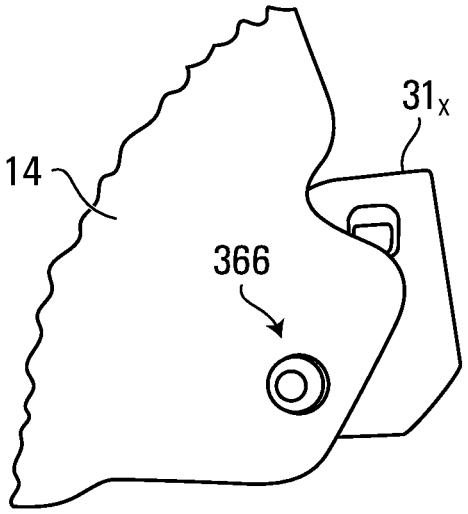
Figure 14:
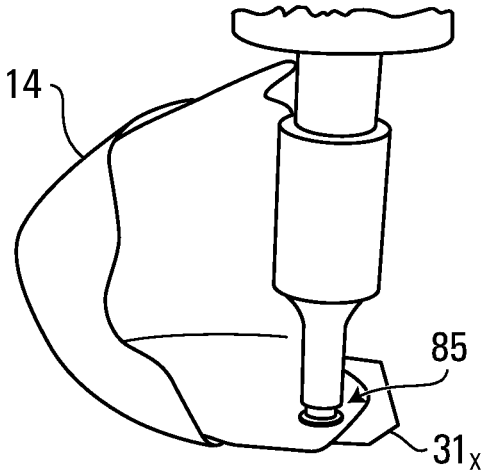

With additional reference in FIGS. 11A and 11B, each of the facings $31_1$, $31_2$ comprises lacing openings $48_1$-$48_L$ that are part of respective ones of the lacing holes $45_1$-$45_L$ to receive the lace 47. In that sense, the facings $31_1$, $31_2$ may be viewed as lacing members. In this example, each of the facings $31_1$, $31_2$ includes a void 49 to receive a given one of the medial and lateral edges $32_1$, $32_2$ of the body 30 that it straddles and that includes lacing openings $50_1$-$50_L$ which are part of respective ones of the lacing holes $45_1$-$45_L$ to receive the lace 47.

In this embodiment, each of the facings $31_1$, $31_2$ is molded such that a shape of that facing is imparted during a molding process in a mold. More particularly, in this embodiment, each of the facings $31_1$, $31_2$ is injection molded. For example, each of the facings $31_1$, $31_2$ may be made from nylon or any other suitable polymeric material, such as thermoplastic polyurethane (TPU), polyvinyl chloride (PVC), or any other thermoplastic or thermosetting polymer.

In other embodiments, the facings $31_1$, $31_2$ may be manufactured in any other suitable way (e.g., cut, stamped, etc.) and/or include any other suitable material (e.g., leather, any synthetic material that resembles leather, and/or any other suitable material).

The facings $31_1$, $31_2$ may be connected to the body 30 of the skate boot 22 in any suitable way. For instance, in some embodiments, each of the facings $31_1$, $31_2$ may be fastened to the body 30 (e.g., via stitching, staples, etc.), glued or otherwise adhesively bonded to the body 30 via an adhesive, or ultrasonically bonded to the body 30.

In this embodiment, each of the facings $\mathbf{31}_1$, $\mathbf{31}_2$ overlaps and is secured to the toe cap 14. This may enhance solidity, integrity and durability of the skate boot 22 proximate to the toe cap 14 and/or may facilitate manufacturing of the skate boot 22. More particularly, in this embodiment, the facing $\mathbf{31}_1$ overlaps and is secured to the medial side portion 61 of the toe cap 14 while the facing $\mathbf{31}_2$ overlaps and is secured to the lateral side portion 63 of the toe cap 14.

To that end, in this embodiment, each of the facings $\mathbf{31}_1$, $\mathbf{31}_2$, which will be denoted $\mathbf{31}_x$, comprises a toe-cap-attachment portion 354 overlapping and attached to the toe cap 14. In this embodiment, the toe-cap-attachment portion 354 comprises an extension 55 of the facing $\mathbf{31}_x$ that extends downwardly and forwardly and overlaps the toe cap 14. The extension 55 of the facing $\mathbf{31}_x$ may sometimes constitute an abrasion pad to protect against abrasion in a lower region of the skate boot 22. Also, in this embodiment the toe cap 14 comprises facing-attachment portions $\mathbf{55}_1$, $\mathbf{55}_2$, which project rearwardly from a proximal end of the toe cap 14, that are respectively part of the medial portion 61 and the lateral portion 63 of the toe cap 14. The toe-cap-attachment portion 354 of the facing $\mathbf{31}_x$ overlaps and is attached to a given one of the facing-attachment portions $\mathbf{55}_1$, $\mathbf{55}_2$ of the toe cap 14, which will be denoted $\mathbf{55}_x$.

In this example of implementation, the toe-cap-attachment portion 354 of the facing $\mathbf{31}_x$ is attached to the facing-attachment portion $\mathbf{55}_x$ of the toe cap 14 by a fastener 366. The fastener 366 may be a mechanical fastener, such as a rivet, a tack, a screw, a nail, stitching, or any other mechanical fastening device, or an adhesive.

In this embodiment, the fastener 366 is other than stitching, i.e., is not stitching. More particularly, in this embodiment, the toe-cap-attachment portion 54 of the facing $\mathbf{31}_x$ is stitchlessly attached (i.e., attached without stitching) to the facing-attachment portion $\mathbf{55}_x$ of the toe cap 14. This may help to enhance interconnection of the facing $\mathbf{31}_x$ and the toe cap 14. In other embodiments, the toe-cap-attachment portion 354 of the facing $\mathbf{31}_x$ may be attached to the facing-attachment portion $\mathbf{55}_x$ of the toe cap 14 by stitching in addition to or instead of the fastener 366.

More particularly, in this embodiment, the fastener 366 is a rivet. In this example, the rivet 366 is molded with a given one of the toe-cap-attachment portion 354 of the facing $\mathbf{31}_x$ and the facing-attachment portion $\mathbf{55}_x$ of the toe cap 14. That is, the rivet 366 is formed during molding of the given one of the toe-cap-attachment portion 54 of the facing $\mathbf{31}_x$ and the facing-attachment portion $\mathbf{55}_x$ of the toe cap 14. In that sense, the rivet 366 can be viewed as an "integrated" rivet that is an integral part of the given one of the toe-cap-attachment portion 354 of the facing $\mathbf{31}_x$ and the facing-attachment portion $\mathbf{55}_x$ of the toe cap 14. This may facilitate manufacturing of the skate boot 22, including by reducing parts and assembly steps.

Figure 15:
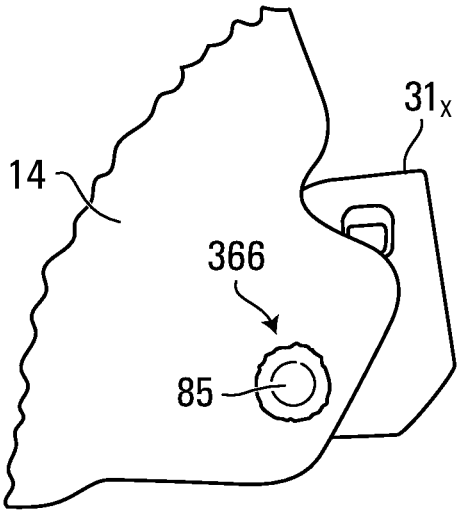

In this example of implementation, with additional references to FIGS. 12 to 15, the rivet 366 is molded with the toe-cap-attachment portion 354 of the facing $\mathbf{31}_x$. More particularly, in this embodiment, the rivet 366 comprises a projection 181 (e.g., a pin) molded with and projecting from an inner surface 82 of the toe-cap-attachment portion 354 of the facing $\mathbf{31}_x$. The facing-attachment portion $\mathbf{55}_x$ of the toe cap 14 comprises an opening 83 receiving the projection 181 of the rivet 366. Once received in the opening 83, an end portion 84 of the projection 181 of the rivet 366 is enlarged to create a head 85 of the rivet 366 that secures the toe-cap-attachment portion 354 of the facing $\mathbf{31}_x$ and the facing-attachment portion $\mathbf{55}_x$ of the toe cap 14 together. In this embodiment, as shown in FIG. 15 this is achieved by heating the end portion 84 of the projection 181 of the rivet 366 so that it melts and deforms to form the head 85 of the rivet 366. For instance, in this embodiment, with the rivet 366 formed of the polymeric material of the facing $\mathbf{31}_x$, the end portion 84 of the projection 181 of the rivet 366 is heated by ultrasonic welding to deform and create the head 85 of the rivet 366.

In this embodiment, the rivet 366, including its head 85 and other parts that deformed by heating, may be sufficient to secure the toe-cap-attachment portion 54 of the facing $\mathbf{31}_x$ to the facing-attachment portion $\mathbf{55}_x$ of the toe cap 14. In other embodiments, there may be more than one fastener such as the fastener 366 to secure the toe-cap-attachment portion 54 of the facing $\mathbf{31}_x$ to the facing-attachment portion $\mathbf{55}_x$ of the toe cap 14 (e.g., two or more rivets such as the rivet 366 or other mechanical fasteners to prevent pivoting of the toe-cap-attachment portion 54 of the facing $\mathbf{31}_x$ relative to the facing-attachment portion $\mathbf{55}_x$ of the toe cap 14).

The liner 36 of the skate boot 22 is affixed to an inner surface 37 of the body 30 and comprises an inner surface 96 for facing the heel HL and medial and lateral sides MS, LS of the player's foot 11 and ankle A. The liner 36 may be affixed to the body 30 by stitching or stapling the liner 36 to the body 30, gluing with an adhesive and/or any other suitable technique. The inner lining 36 may be made of a soft material (e.g., a fabric made of NYLON® fibers, polyester fibers or any other suitable fabric). The footbed 38 may include a foam layer, which may be made of a polymeric material. For example, the footbed 38, in some embodiments, may include a foam-backed fabric. The footbed 38 is mounted inside the body 30 and comprises an upper surface 106 for receiving the plantar surface PS of the player's foot 11. In this embodiment, the footbed 38 affixed to the sole portion 69 of the body 30 by an adhesive and/or any other suitable technique. In other embodiments, the footbed 38 may be removable. In some embodiments, the footbed 38 may also comprise a wall projecting upwardly from the upper surface 106 to partially cup the heel HL and extend up to a medial line of the player's foot 11.

Figure 16:
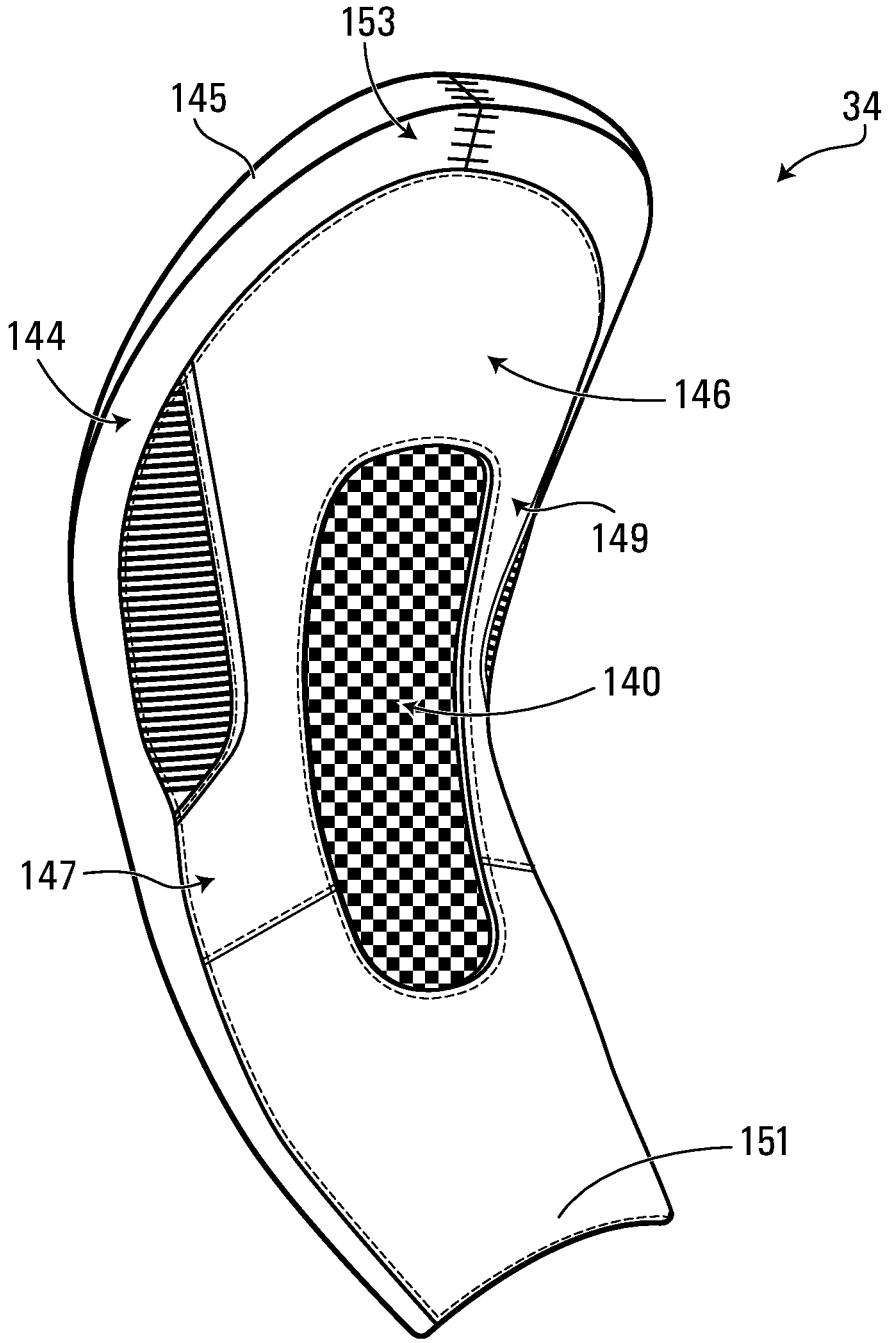
FIG. 16 is a perspective view of a tongue of the skate boot.

The tongue 34 extends upwardly and rearwardly from the toe portion 19 of the skate boot 22 for overlapping the top surface TS of the player's foot 11. In this embodiment, the tongue 34 is affixed to the body 30. In particular, in this embodiment, the tongue 34 is fastened to the toe cap 14. With additional reference to FIG. 16, in some embodiments, the tongue 34 comprises a core 140 defining a section of the tongue 34 with increased rigidity, a padding member (not shown) for absorbing impacts to the tongue 34, a peripheral member 144 for at least partially defining a periphery 145 of the tongue 34, and a cover member 146 configured to at least partially define a front surface of the tongue 34. The tongue 34 defines a lateral portion 147 overlying a lateral portion of the player's foot 11 and a medial portion 149 overlying a medial portion of the player's foot 11. The tongue 34 also defines a distal end portion 151 for affixing to the toe cap 14 (e.g., via stitching, riveting, welding (e.g. high-frequency welding), bonding) and a proximal end portion 153 that is nearest to the player's shin S. The core 140 may be made of foam or similar materials to that of the body 30 and may be formed by injection molding in a similar manner to that of the body 30, as described herein.

Figure 17:
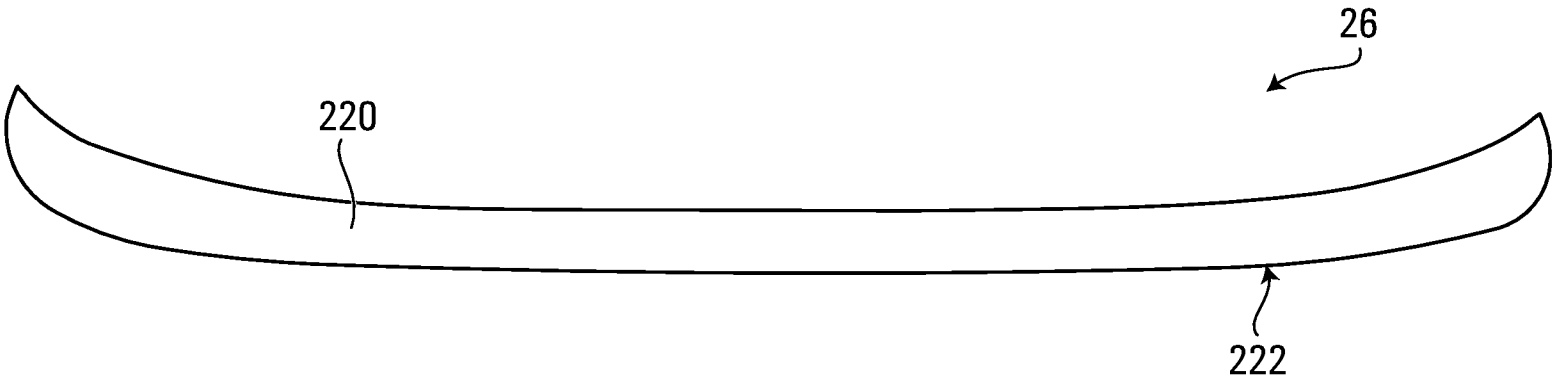
FIG. 17 is a side view of a blade of a skating device of the skate.

With additional reference to FIG. 17, the blade 26 comprises an ice-contacting material 220 including an ice-contacting surface 222 for sliding on the skating surface 12 while the player skates. In this embodiment, the ice-contacting material 220 is a metallic material (e.g., stainless steel). The ice-contacting material 220 may be any other suitable material in other embodiments.

Figure 18:
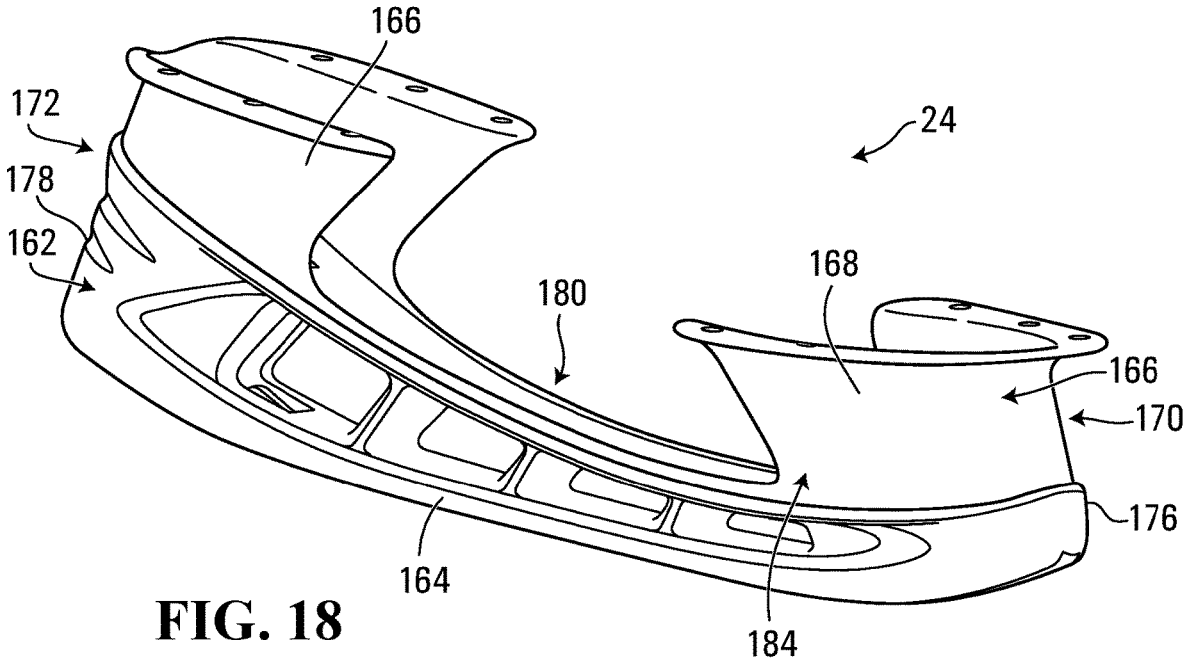
FIGS. 18 to 20 show views of a blade holder of the skate.
Figure 19:
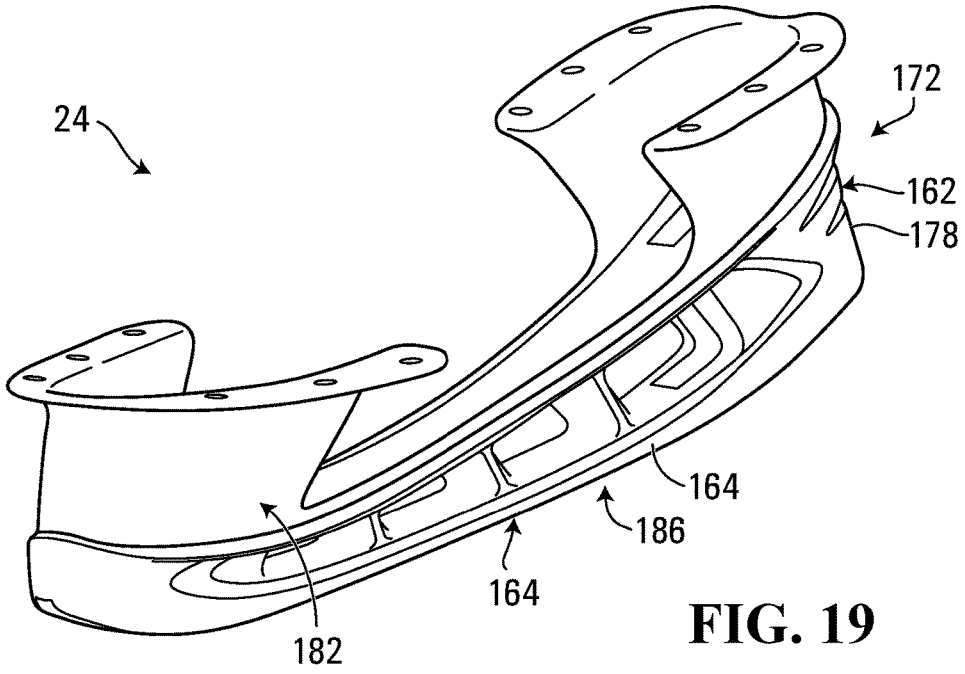
Figure 20:
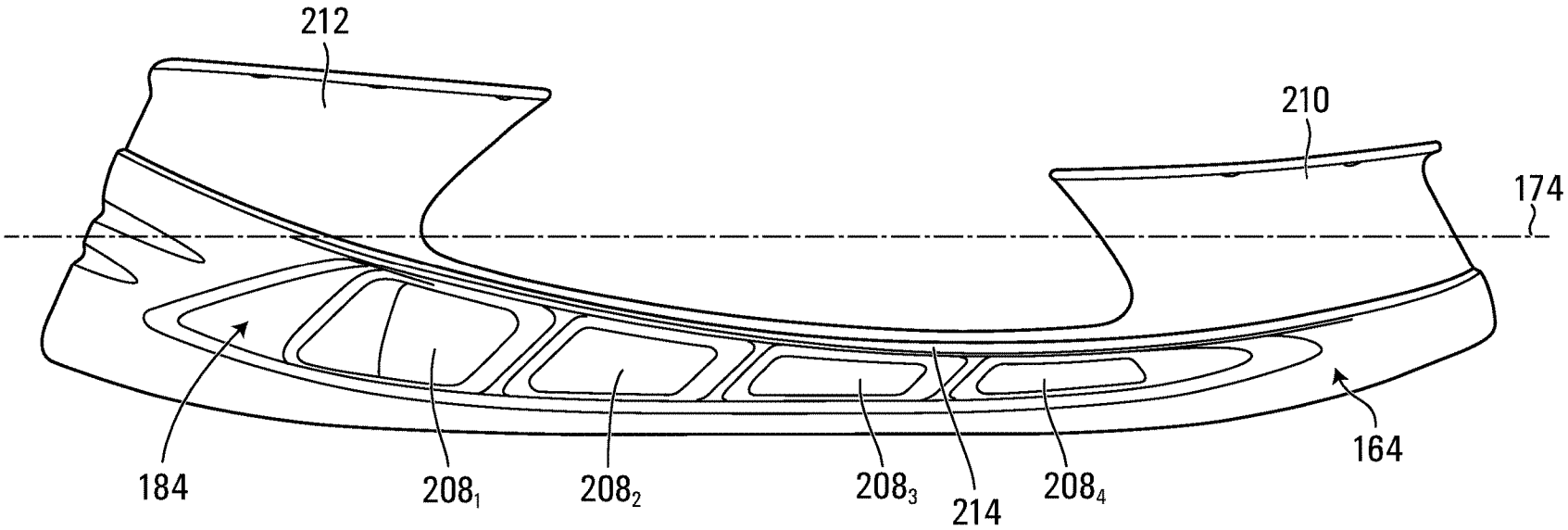

With continued reference to FIGS. 18 to 20, the blade holder 24 comprises a lower portion 162 comprising a blade-retaining base 164 that retains the blade 26 and an upper portion 166 comprising a support 168 that extends upwardly from the blade-retaining base 164 towards the skate boot 22 to interconnect the blade holder 24 and the skate boot 22. A front portion 170 of the blade holder 24 and a rear portion 172 of the blade holder 24 define a longitudinal axis 174 of the blade holder 24. The front portion 170 of the blade holder 24 includes a frontmost point 176 of the blade holder 24 and extends beneath and along the player's forefoot in use, while the rear portion 172 of the blade holder 24 includes a rearmost point 178 of the blade holder 24 and extends beneath and along the player's hindfoot in use. An intermediate portion 180 of the blade holder 24 is between the front and rear portions 170, 172 of the blade holder 24 and extends beneath and along the player's midfoot in use. The blade holder 24 comprises a medial side 182 and a lateral side 184 that are opposite one another.

Figure 21:
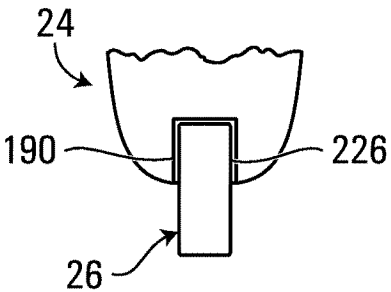

The blade-retaining base 164 is elongated in the longitudinal direction of the blade holder 24 and is configured to retain the blade 26 such that the blade 26 extends along a bottom portion 186 of the blade-retaining base 164 to contact the skating surface 12. To that end, the blade-retaining base 164 comprises a blade-retention portion 188 to face and retain the blade 26. In this embodiment, as shown in FIG. 21, the blade-retention portion 188 comprises a recess 190 in which an upper portion of the blade 26 is disposed.

Figure 22:
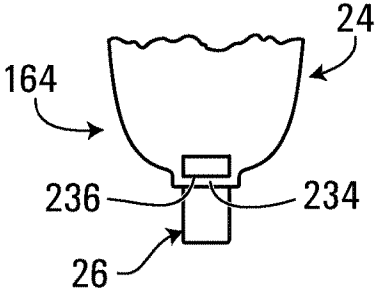
FIGS. 21 to 24 show different examples of embodiments in which the blade is affixed to the blade holder of the skating device of the skate.
Figure 23:
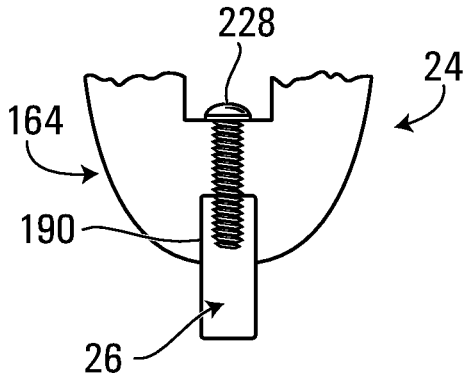
Figure 24:
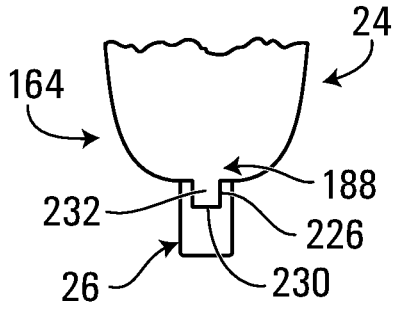

The blade holder 24 can retain the blade 26 in any suitable way. For instance, in this embodiment, the blade 26 may be permanently affixed to the blade holder 24 (i.e., not intended to be detached and removed from the blade holder 24). For example, as shown in FIG. 22, the blade 26 and the blade-retaining base 164 of the blade holder 24 may be mechanically interlocked via an interlocking portion 234 of one of the blade-retaining base 164 and the blade 26 that extends into an interlocking void 236 of the other one of the blade-retaining base 164 and the blade 26. For instance, in some cases, the blade 26 can be positioned in a mold used for molding the blade holder 24 such that, during molding, the interlocking portion 234 of the blade-retaining base 164 flows into the interlocking void 236 of the blade 26 (i.e., the blade holder 24 is overmolded onto the blade 26). In some embodiments, as shown in FIGS. 21, 23 and 24, the blade holder 24 may retain the blade 26 using an adhesive 226 and/or one or more fasteners 228. For instance, in some embodiments, as shown in FIG. 21, the recess 190 of the blade holder 24 may receive the upper portion of the blade 26 that is retained by the adhesive 226. The adhesive 226 may be an epoxy-based adhesive, a polyurethane-based adhesive, or any suitable adhesive. In some embodiments, instead of or in addition to using an adhesive, as shown in FIG. 23, the recess 190 of the blade holder 24 may receive the upper part of the blade 26 that is retained by the one or more fasteners 228. Each fastener 228 may be a rivet, a screw, a bolt, or any other suitable mechanical fastener. Alternatively or additionally, in some embodiments, as shown in FIG. 24, the blade-retention portion 188 of the blade holder 24 may extend into a recess 230 of the upper part of the blade 26 to retain the blade 26 using the adhesive 226 and/or the one or more fasteners 228. For instance, in some cases, the blade-retention portion 188 of the blade-retaining base 164 of the blade holder 24 may comprise a projection 232 extending into the recess 230 of the blade 26.

In this embodiment, the blade-retaining base 164 comprises a plurality of apertures $\mathbf{208_1}$-$\mathbf{208_4}$ distributed in the longitudinal direction of the blade holder 24 and extending from the medial side 182 to the lateral side 184 of the blade holder 24. In this example, respective ones of the apertures $\mathbf{208_1}$-$\mathbf{208_4}$ differ in size. The apertures $\mathbf{208_1}$-$\mathbf{208_4}$ may have any other suitable configuration, or may be omitted, in other embodiments.

The blade-retaining base 164 may be configured in any other suitable way in other embodiments.

The support 168 is configured for supporting the skate boot 22 above the blade-retaining base 164 and transmit forces to and from the blade-retaining base 164 during skating. In this embodiment, the support 168 comprises a front pillar 210 and a rear pillar 212 which extend upwardly from the blade-retaining base 164 towards the skate boot 22. The front pillar 210 extends towards the front portion 56 of the skate boot 22 and the rear pillar 212 extends towards the rear portion 58 of the skate boot 22. The blade-retaining base 164 extends from the front pillar 210 to the rear pillar 212. More particularly, in this embodiment, the blade-retaining base 164 comprises a bridge 214 interconnecting the front and rear pillars 210, 212.

The skate 10 may be implemented in any other suitable manner in other embodiments.

Figure 25:
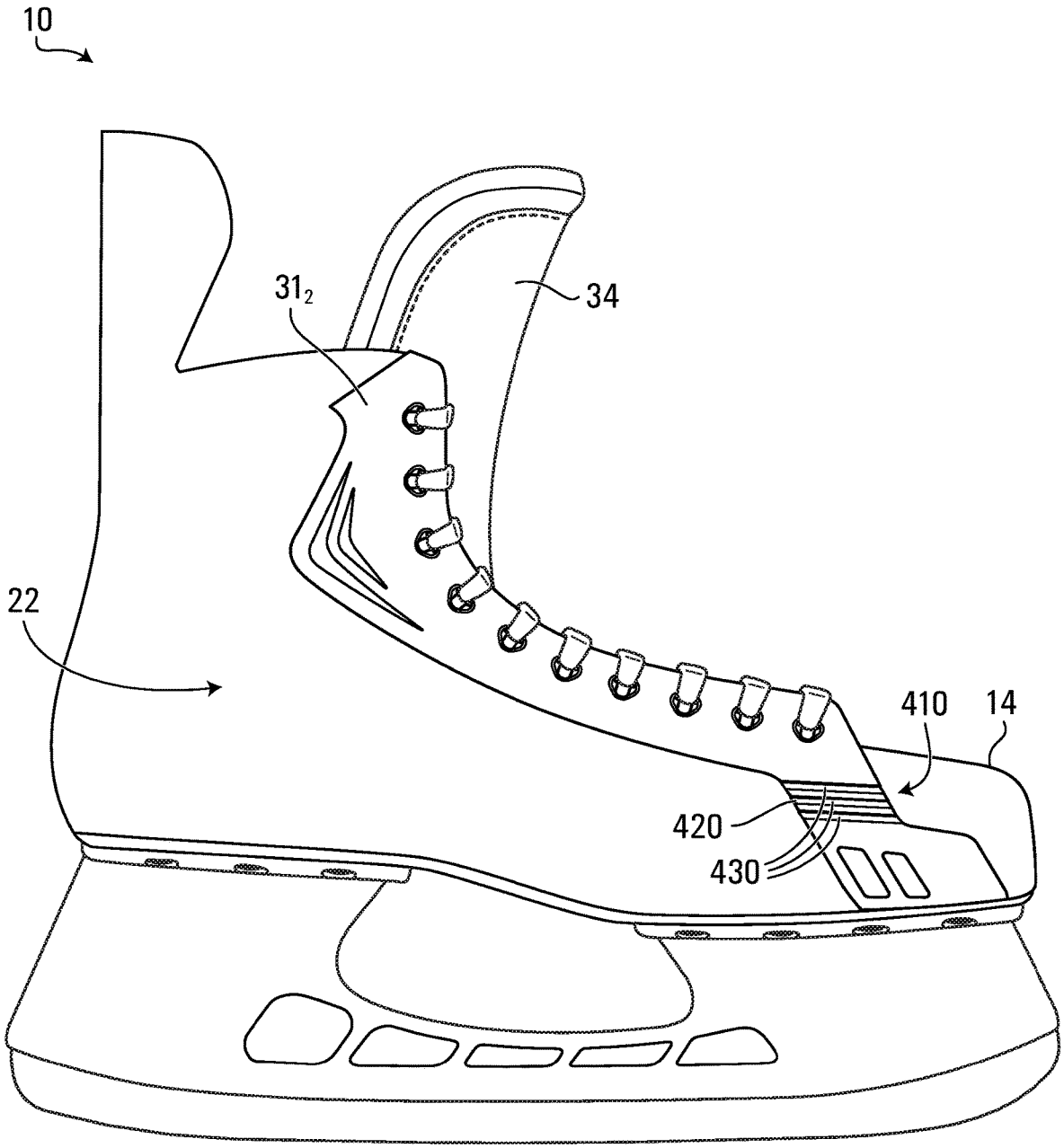
FIG. 25 shows an example of another embodiment of the facing of the skate boot.

For example, in some embodiments, as shown in FIG. 25, each of the facings $\mathbf{31_1}$, $\mathbf{31_2}$ may comprise a wrap-vamping 410 including a flex zone 420 to wrap the skate boot 22 on top of the player's forefoot. For instance, this may be useful where the toe cap 14 is reduced in height and to facilitate wrapping each of the facings $\mathbf{31_1}$, $\mathbf{31_2}$ on top of the player's forefoot.

The flex zone 420 of the wrap-vamping 410 of each of the facings $\mathbf{31_1}$, $\mathbf{31_2}$ is a zone facilitating flexion of that facing over at least one of the toe cap 14 and the tongue 34 compared to an adjacent part of that facing. In this embodiment, the flex zone 420 of the wrap-vamping 410 of each of the facings $\mathbf{31_1}$, $\mathbf{31_2}$ comprises a zone of reduced material (e.g., a zone of reduced thickness or a zone without material) at a localized position on each of the facings $\mathbf{31_1}$, $\mathbf{31_2}$, such as a zone comprising one or more voids 430 (e.g. recesses, such as grooves; openings; etc.) which tend to facilitate flexing of that facing at its respective localized position.

In this embodiment, the flex zone 420 of the wrap-vamping 410 of each of the facings $\mathbf{31_1}$, $\mathbf{31_2}$ is located proximate a given one of the facing-attachment portions $\mathbf{55_1}$, $\mathbf{55_2}$ of the toe cap 14 (i.e. proximate a given one of the medial part 61 and the lateral part 63 of the toe cap 14). In other embodiments, the flex zone 420 of the wrap-vamping 410 of each of the facings $\mathbf{31_1}$, $\mathbf{31_2}$ may be located alternatively or additionally elsewhere. This may provide an even more adjusted fit of the skate boot 22 on the player's foot.

The flex zone 420 of the wrap-vamping 410 of each of the facings $\mathbf{31_1}$, $\mathbf{31_2}$ may be implemented in other ways in other embodiments.

For example, in other embodiments, the flex zone 420 of the wrap-vamping 410 of each of the facings $\mathbf{31_1}$, $\mathbf{31_2}$ may comprise a material which is more flexible (e.g., has a lower modulus of elasticity and/or has a lower hardness) than a material of an adjacent part of that facing. The material of the flex zone 420 of the wrap-vamping 410 of each of the facings $\mathbf{31_1}$, $\mathbf{31_2}$ may comprise, for instance, elastomeric material (e.g. rubber), while the material of the adjacent part of that facing comprises non-elastomeric material.

Figure 26:
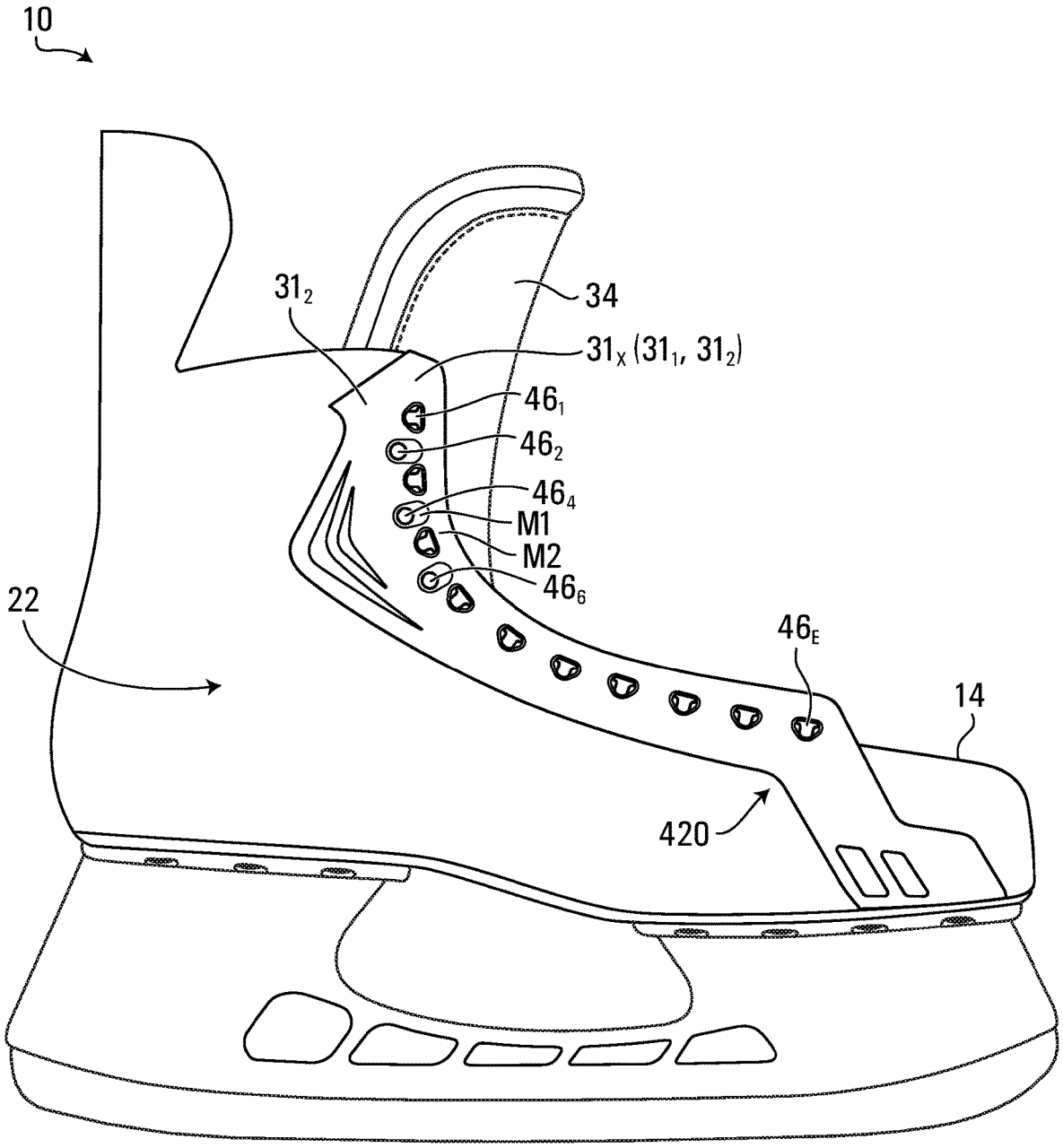
FIG. 26 shows another example of an embodiment of the facing of the skate boot.

As another example, in some embodiments, as shown in FIG. 26, a flexibility of each of the facings $\mathbf{31}_1$, $\mathbf{31}_2$ may be adjustable to adjust a resistance to flexion of the player's foot, whereby each of respective ones of the eyelets $\mathbf{46}_1$-$\mathbf{46}_E$ of each facing $\mathbf{31}_x$, which in this example are the eyelets $\mathbf{46}_2$, $\mathbf{46}_4$, $\mathbf{46}_6$, comprises flexible material M1 that is more flexible than adjacent material M2 of the facing $\mathbf{31}_x$ to be compressed when the player's foot is flexed. In that sense, the eyelets $\mathbf{46}_2$, $\mathbf{46}_4$, $\mathbf{46}_6$ may be referred to as "rebound" eyelets.

For example, in some embodiments, a hardness (e.g., Shore A hardness) of the flexible material M1 of the rebound eyelets $\mathbf{46}_2$, $\mathbf{46}_4$, $\mathbf{46}_6$ may be lower than a hardness of the adjacent material M2 of the facing $\mathbf{31}_x$. This may be useful in that a player may adjust the flexibility of each of the facings $\mathbf{31}_1$, $\mathbf{31}_2$ by either using or not using one or more of the rebound eyelets $\mathbf{46}_2$, $\mathbf{46}_4$, $\mathbf{46}_6$ when lacing up the skate. This may provide customizable flexibility to allow greater comfort (e.g. easier to flex forwardly the skate during skating action of the player) and/or greater reactivity (e.g. better energy transfer from the player to the skate and thus indirectly to the skating surface when skating) of the skate when worn. For instance, in some embodiments, on a Shore A hardness scale, a ratio of the hardness of the adjacent material M2 of the facing $\mathbf{31}_x$ over the hardness of the flexible material M1 of the rebound eyelets $\mathbf{46}_2$, $\mathbf{46}_4$, $\mathbf{46}_6$ may be no more than 7, in some cases no more than 5, in some cases no more than 2.5, in some cases no more than 1.5 and I some cases an even lesser ratio. In some cases, the hardness may be evaluated according to ASTM D2240 ("Test Method for Rubber Property-Durometer Hardness"). Alternatively, in other embodiments, the hardness of the flexible material M1 of the rebound eyelets $\mathbf{46}_2$, $\mathbf{46}_4$, $\mathbf{46}_6$ may be greater than the hardness of the adjacent material M2 of the facing $\mathbf{31}_x$.

Alternatively or additionally, in some embodiments, a modulus of elasticity (i.e., a tensile modulus of elasticity) of the flexible material M1 of the rebound eyelets $\mathbf{46}_2$, $\mathbf{46}_4$, $\mathbf{46}_6$ may be less than a modulus of elasticity of the adjacent material M2. For instance, in some embodiments, a ratio of the modulus of elasticity of the adjacent material M2 of the facing $\mathbf{31}_x$ over the modulus of elasticity of the flexible material M1 of the rebound eyelets $\mathbf{46}_2$, $\mathbf{46}_4$, $\mathbf{46}_6$ may be no more than 10, in some cases no more than 8, in some cases no more than 6, in some cases no more than 3, and in some cases even less In some cases, the modulus of elasticity may be evaluated according to ASTM D638 ("Standard Test Method for Tensile Properties of Plastics"). Alternatively, in other embodiments, the modulus of elasticity of the flexible material M1 of the rebound eyelets $\mathbf{46}_2$, $\mathbf{46}_4$, $\mathbf{46}_6$ may be greater than the modulus of elasticity of the adjacent material M2 of the facing $\mathbf{31}_x$.

In other embodiments, the material M1 of the rebound eyelets $\mathbf{46}_2$, $\mathbf{46}_4$, $\mathbf{46}_6$ may be the same as the adjacent material M2 of the facing $\mathbf{31}_x$. For instance, in some embodiments, a rebound effect of the rebound eyelets $\mathbf{46}_2$, $\mathbf{46}_4$, $\mathbf{46}_6$ may be obtained by a thin dome shaped wall that flexes upon application of a load thereon (e.g., when the lace is tightened and while the player is wearing and skating with the skate, etc.).

The rebound eyelets $\mathbf{46}_2$, $\mathbf{46}_4$, $\mathbf{46}_6$ may be made in many ways. For instance, in some embodiments, the eyelets $\mathbf{46}_2$, $\mathbf{46}_4$, $\mathbf{46}_6$ are made separately (e.g. molded separately) from the facing $\mathbf{31}_x$ and affixed (e.g. fastened, bonded, embedded in receiving portions, etc.) to the facing $\mathbf{31}_x$ after it being molded. This may allow customization of the facing $\mathbf{31}_x$ based on the player's preferences. In some other embodiments, the eyelets $\mathbf{46}_2$, $\mathbf{46}_4$, $\mathbf{46}_6$ may be molded to the facing $\mathbf{31}_x$ by placing the eyelets $\mathbf{46}_2$, $\mathbf{46}_4$, $\mathbf{46}_6$ in the mold prior to molding the facing $\mathbf{31}_x$.

Figure 27:
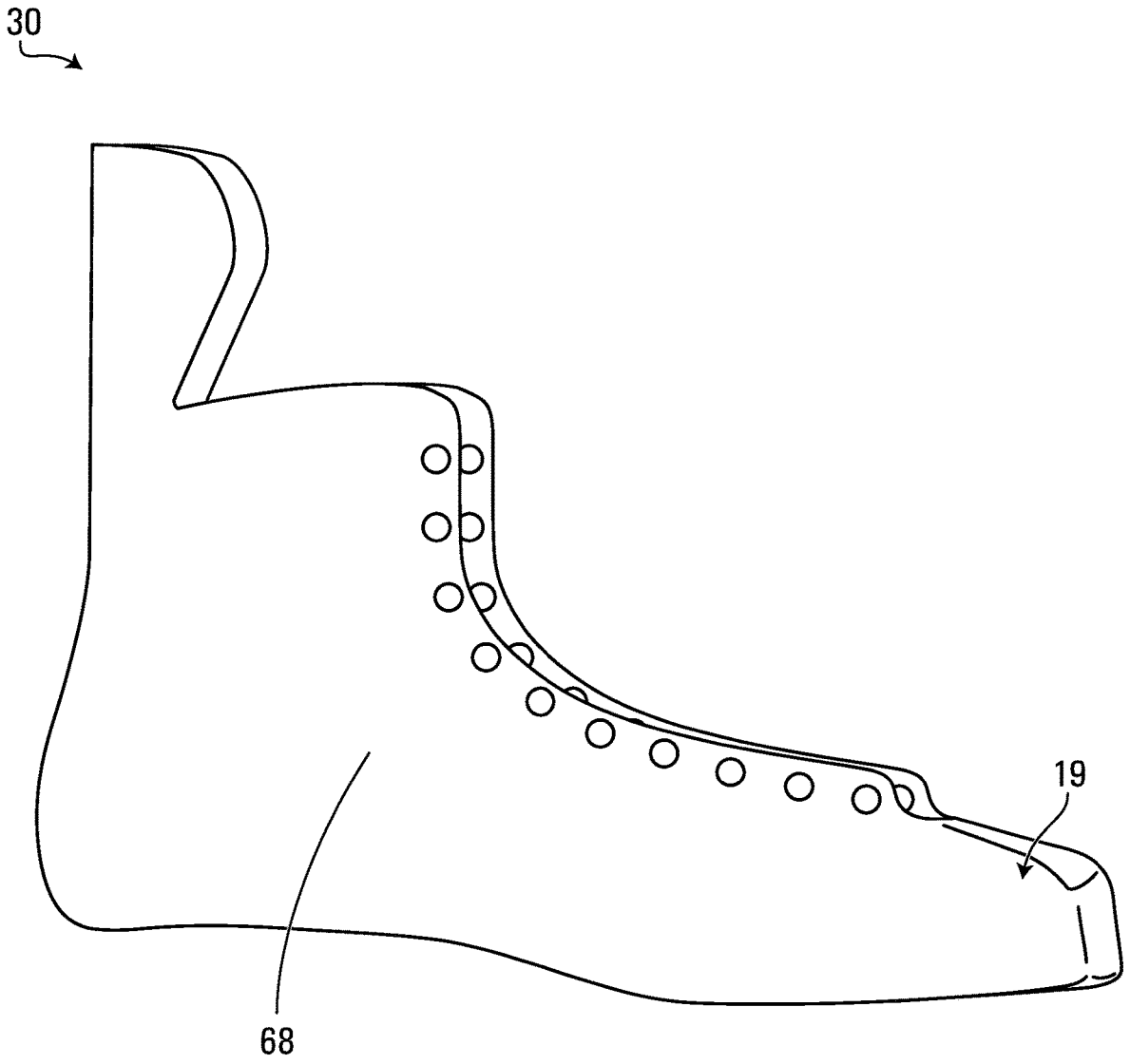
FIG. 27 shows an example of an embodiment where a toe portion of the skate boot is molded with the body of the skate boot.

As another example, in some embodiments, as shown in FIG. 27 instead of including the toe cap 14 that is separate from and fastened to the body 30 of the skate boot 22, the toe portion 19 of the skate boot 22 may be an integral part of the body 30 that is molded together with the medial and lateral side portions 66, 68 of the body 30 and may be morphologically configured to accommodate the toes $T_1$-$T_5$ of the player's foot in accordance with their anatomy, including by providing more internal space in the medial portion 61 of the toe cap 14 proximate to the player's big toe $T_1$ than in the lateral portion 63 of the toe cap 14 proximate to the player's little toe $T_5$, as discussed above in respect of the toe cap 14.

Figure 28A:
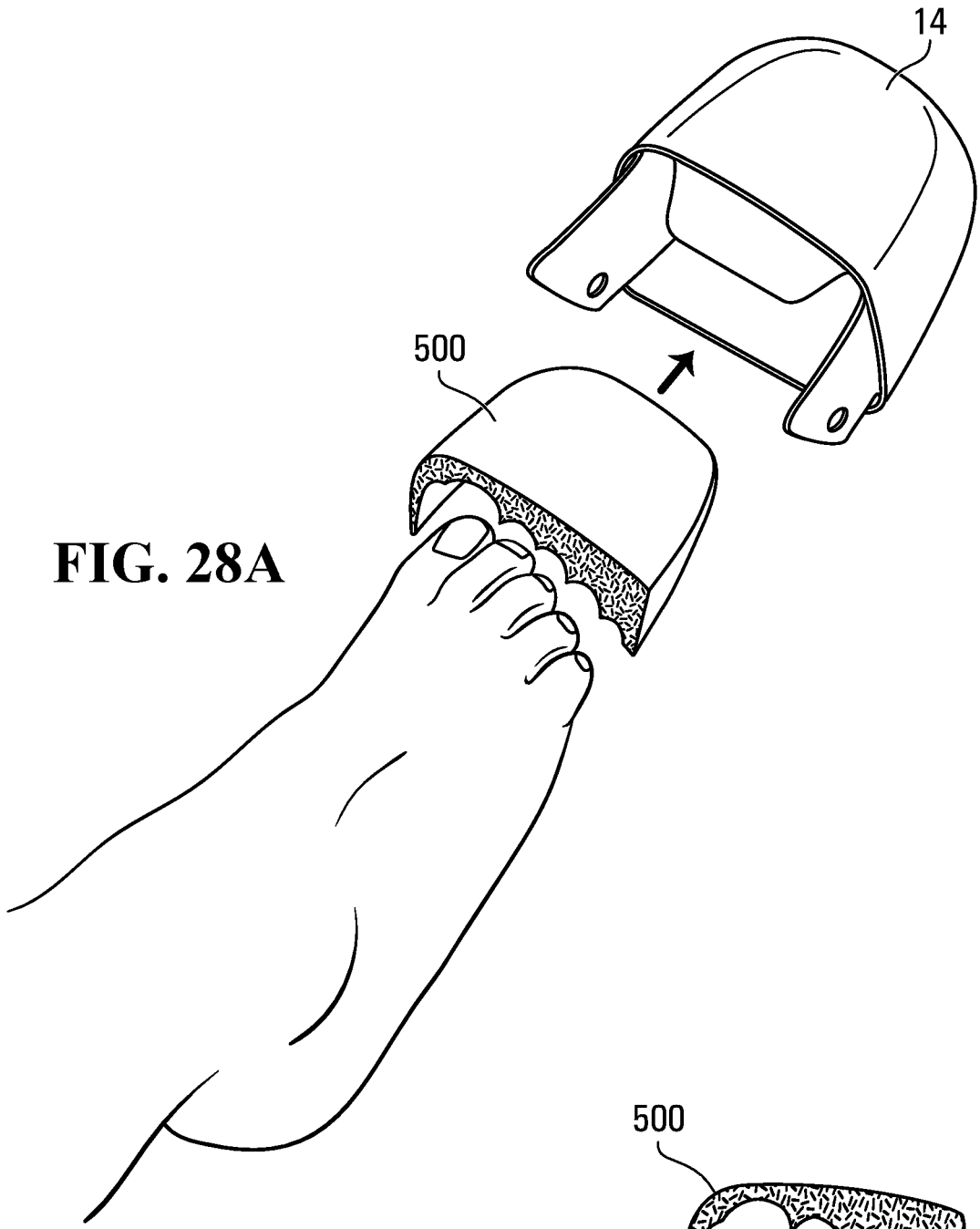
FIGS. 28A and 28B show an example of an embodiment of a toe-receiving insert for insertion into a toe portion of the skate boot.
Figure 28B:
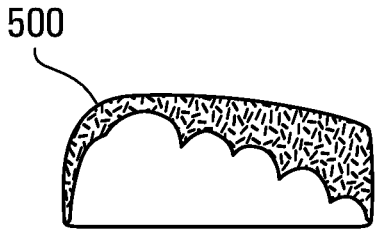

As another example, in some embodiments, as shown in FIGS. 28A and 28B, a toe-receiving insert 500 may be inserted into the toe portion 19 of the skate boot 22 (whether including the toe cap 14 that is separate from and fastened to the body 30 of the skate boot 22 or being an integral part of the body 30) and morphologically configured to accommodate the toes $T_1$-$T_5$ of the player's foot in accordance with their anatomy, including by providing more internal space in the medial portion 61 of the toe cap 14 proximate to the player's big toe $T_1$ than in the lateral portion 63 of the toe cap 14 proximate to the player's little toe $T_5$, as discussed above in respect of the toe cap 14.

Figure 29:
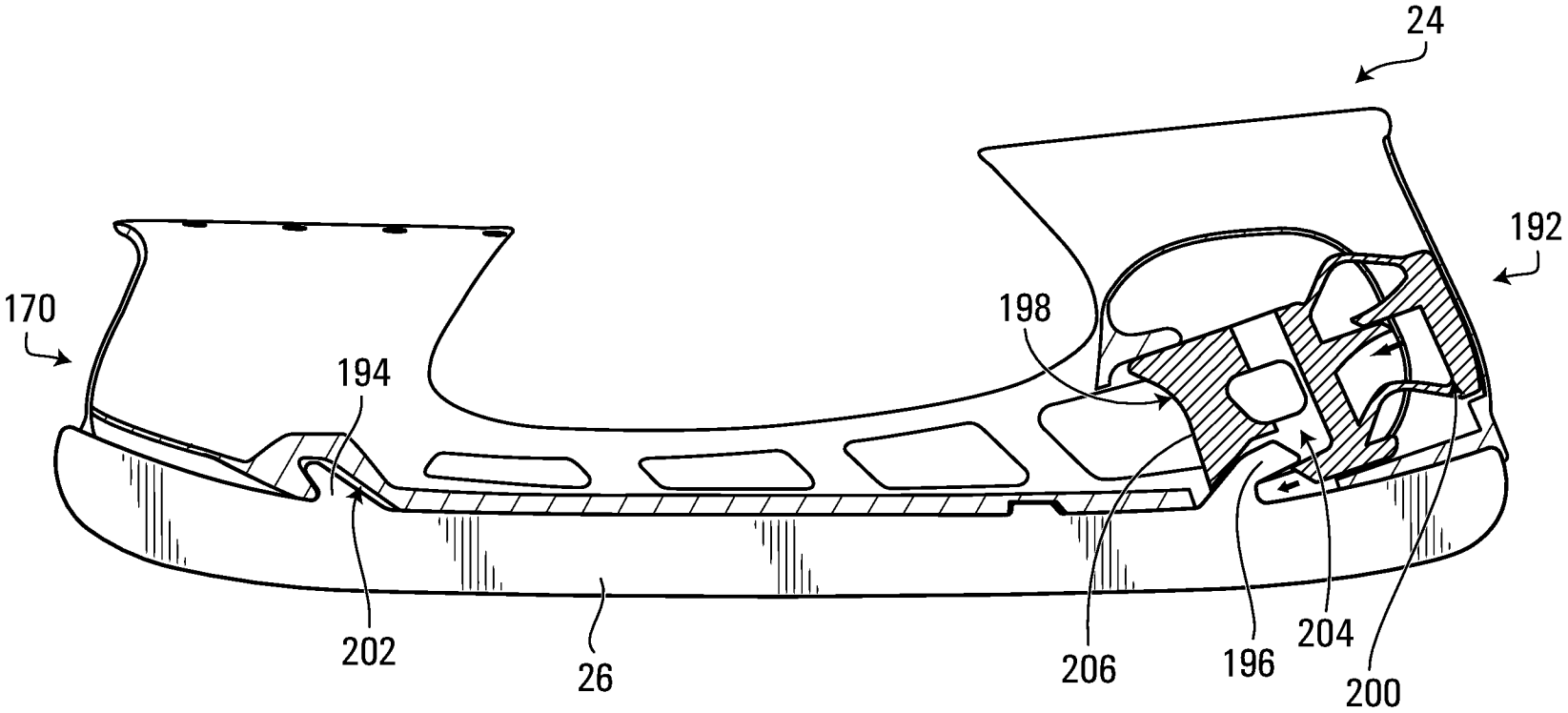
FIG. 29 is a cross-sectional view of the blade holder in an embodiment in which the blade holder comprises a blade-detachment mechanism.

In some embodiments, the blade holder 24 may retain the blade 26 in any other suitable way. For example, in other embodiments, as shown in FIG. 29, the blade holder 24 comprises a blade-detachment mechanism 192 such that the blade 26 is selectively detachable and removable from, and attachable to, the blade holder 24 (e.g., when the blade 26 is worn out or otherwise needs to be replaced or removed from the blade holder 24).

More particularly, in this embodiment, the blade 26 includes a plurality of projections 194, 196. The blade-detachment mechanism 192 includes an actuator 198 and a biasing element 200 which biases the actuator 198 in a direction towards the front portion 170 of the blade holder 24. In this embodiment, the actuator 198 comprises a trigger. To attach the blade 26 to the blade holder 24, the front projection 194 is first positioned within a hollow space 202 (e.g., a recess or hole) of the blade holder 24. The rear projection 196 can then be pushed upwardly into a hollow space 204 (e.g., a recess or hole) of the blade holder 24, thereby causing the biasing element 200 to bend and the actuator 198 to move in a rearward direction. In this embodiment, the rear projection 196 will eventually reach a position which will allow the biasing element 200 to force the actuator 198 towards the front portion 170 of the blade holder 24, thereby locking the blade 26 in place. The blade 26 can then be removed by pushing against a finger-actuating surface 206 of the actuator 198 to release the rear projection 196 from the hollow space 204 of the blade holder 24. Thus, in this embodiment, the blade-detachment mechanism 192 is free of any threaded fastener (e.g., a screw or bolt) to be manipulated to detach and remove the blade 26 from the blade holder 24 or to attach the blade 26 to the blade holder 24.

Further information on examples of implementation of the blade-detachment mechanism 192 in some embodiments may be obtained from U.S. Pat. No. 8,454,030 hereby incorporated by reference herein. The blade-detachment mechanism 192 may be configured in any other suitable way in other embodiments.

Figure 30:
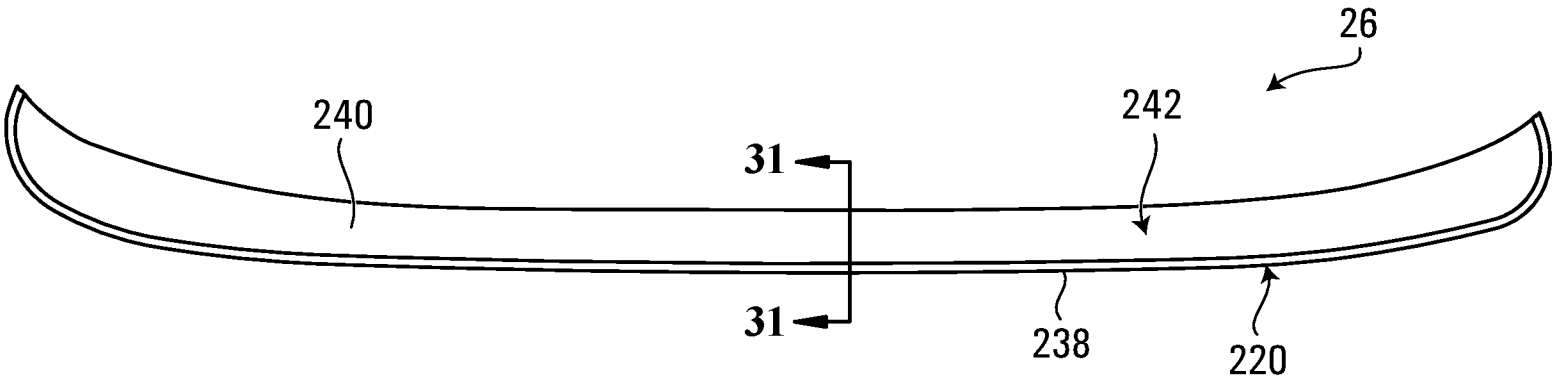
FIG. 30 is a side view of an example of an embodiment of the blade of the skating device.
Figure 31:
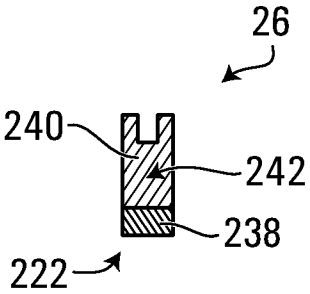
FIG. 31 is a cross-sectional view of the blade taken along line 31-31 of FIG. 30.

The blade 26 may be implemented in any other suitable way in other embodiments. For example, in some embodiments, as shown in FIGS. 30 and 31, the blade 26 may comprise a lower member 238 that is made of the ice-contacting material 220 and includes the ice-contacting surface 222 and an upper member 240 connected to the lower member 238 and made of a material 242 different from the ice-contacting material 220. The lower member 238 and the upper member 240 of the blade 26 may be retained together in any suitable way. For example, in some cases, the lower member 238 may be adhesively bonded to the upper member 240 using an adhesive. As another example, in addition to or instead of being adhesively bonded, the lower member 238 and the upper member 240 may be fastened using one or more fasteners (e.g., rivets, screws, bolts, etc.). As yet another example, the lower member 238 and the upper member 240 may be mechanically interlocked by an interlocking portion of one of the lower member 238 and the upper member 240 that extends into an interlocking space (e.g., one or more holes, one or more recesses, and/or one or more other hollow areas) of the other one of the lower member 238 and the upper member 240 (e.g., the upper member 240 may be overmolded onto the lower member 238).

Although in embodiments considered above the skate 10 is designed for playing ice hockey on the skating surface 12 which is ice, in other embodiments, the skate 10 may be constructed using principles described herein for playing roller hockey or another type of hockey (e.g., field or street hockey) on the skating surface 12 which is a dry surface (e.g., a polymeric, concrete, wooden, or turf playing surface or any other dry surface on which roller hockey or field or street hockey is played). Thus, in other embodiments, instead of comprising the blade 26, the skating device 28 may comprise a set of wheels to roll on the dry skating surface 12 (i.e., the skate 10 may be an inline skate or other roller skate).

In some examples of implementation, any feature of any embodiment described herein may be used in combination with any feature of any other embodiment described herein.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

In case of any discrepancy, inconsistency, or other difference between terms used herein and terms used in any document incorporated by reference herein, meanings of the terms used herein are to prevail and be used.

Although various embodiments have been illustrated, this was for purposes of description but should not be limiting. Various modifications will become apparent to those skilled in the art.

The invention claimed is:

1. A skate comprising a skate boot and a skating device disposed below the skate boot, the skate boot defining a cavity to receive a foot of a user, the skate boot comprising:

an ankle portion configured to receive an ankle of the user;

a heel portion configured to receive a heel of the user's foot;

a medial side portion configured to face a medial side of the user's foot;

a lateral side portion configured to face a lateral side of the user's foot;

a sole portion configured to face a plantar surface of the user's foot; and a toe cap comprising an internal void to receive toes of the user's foot, which include a big toe, an index toe, a middle toe, a ring toe, and a little toe;

wherein: the toe cap comprises a medial part including a medial region of the internal void of the toe cap configured to receive the big toe of the user's foot: the toe cap comprises a lateral part including a lateral region of the internal void of the toe cap configured to receive the little toe of the user's foot; a periphery of the toe cap is shaped such that the medial part of the toe cap is taller than the lateral part of the toe cap; and an apex of the medial part of the toe cap is located between a frontmost lacing hole of the skate boot and a front end of the toe cap in a longitudinal direction of the skate boot.

2. The skate of claim 1, wherein a height of the internal void of the toe cap varies in a widthwise direction of the skate boot such that the height of the internal void of the toe cap at the medial region of the internal void of the toe cap is greater than the height of the internal void of the toe cap at the lateral region of the internal void of the toe portion cap.

3. The skate of claim 2, wherein a proximal region of the internal void of the toe cap configured to receive proximal ends of the toes of the user's foot is larger than a distal region of the internal void of the toe cap configured to receive distal ends of the toes of the user's foot.

4. The skate of claim 3, wherein the height of the internal void of the toe cap varies in a longitudinal direction of the skate boot such that the height of the internal void of the toe cap at the proximal region of the internal void of the toe cap is greater than the height of the internal void of the toe cap at the distal region of the internal void of the toe cap.

5. The skate of claim 4, wherein a ratio of the height of the internal void of the toe cap at the proximal region of the internal void of the toe cap over the height of the internal void of the toe cap at the distal region of the internal void of the toe cap is at least 1.2.

6. The skate of claim 4, wherein a ratio of the height of the internal void of the toe cap at the proximal region of the internal void of the toe cap over the height of the internal void of the toe cap at the distal region of the internal void of the toe cap is at least 1.4.

7. The skate of claim 2, wherein a ratio of the height of the internal void of the toe cap at the medial region of the internal void of the toe cap over the height of the internal void of the toe cap at the lateral region of the internal void of the toe cap is at least 1.1.

8. The skate of claim 2, wherein a ratio of the height of the internal void of the toe cap at the medial region of the internal void of the toe cap over the height of the internal void of the toe cap at the lateral region of the internal void of the toe cap is at least 1.2.

9. The skate of claim 2, wherein the height of the internal void of the toe cap decreases from the medial region of the internal void of the toe cap to the lateral region of the internal void of the toe cap.

10. The skate of claim 1, wherein the periphery of the toe cap comprises a top surface extending downwardly from the medial part of the toe cap to the lateral part of the toe cap.

11. The skate of claim 10, wherein the top surface of the periphery of the toe cap is slanted downwardly from the medial part of the toe cap to the lateral part of the toe cap.

12. The skate of claim 1, wherein a ratio of a height of the periphery of the toe cap at the medial part of the toe cap over the height of the periphery of the toe cap at the lateral part of the toe cap is at least 1.1.

13. The skate of claim 1, wherein a ratio of a height of the periphery of the toe cap at the medial part of the toe cap over the height of the periphery of the toe cap at the lateral part of the toe cap is at least 1.2.

14. The skate of claim 1, wherein: the toe cap comprises a proximal part configured to receive proximal ends of the toes of the user's foot and a distal part configured to receive distal ends of the toes of the user's foot; and the periphery of the toe cap is shaped such that the proximal part of the toe cap is taller than the distal part of the toe cap.

15. The skate of claim 14, wherein the periphery of the toe cap comprises a top surface extending downwardly from the medial part of the toe cap to the lateral part of the toe cap and extending downwardly form the proximal part of the toe cap to the distal part of the toe cap.

16. The skate of claim 15, wherein the top surface of the periphery of the toe cap is slanted downwardly from the medial part of the toe cap to the lateral part of the toe cap and slanted downwardly from the proximal part of the toe cap to the distal part of the toe cap.

17. The skate of claim 14, wherein a ratio of a height of the periphery of the toe cap at the proximal part of the toe cap over the height of the periphery of the toe cap at the distal part of the toe cap is at least 1.2.

18. The skate of claim 14, wherein a ratio of a height of the periphery of the toe cap at the proximal part of the toe cap over the height of the periphery of the toe cap at the distal part of the toe cap is at least 1.4.

19. The skate of claim 1, wherein the internal void of the toe cap is a single hollow space to receive all the toes of the user's foot.

20. The skate of claim 1, comprising a facing connected to a given one of the medial side portion and the lateral side portion of the skate boot and overlapping and secured to the toe cap.

21. The skate of claim 20, wherein: the toe cap comprises a facing-attachment portion on a side of the toe cap; and the facing comprises a toe-cap-attachment portion overlapping and attached to the toe cap.

22. The skate of claim 21, wherein the toe-cap-attachment portion of the facing extends downwardly and forwardly to overlap the toe cap.

23. The skate of claim 20, wherein the facing is fastened to the toe cap by a fastener other than stitching.

24. The skate of claim 23, wherein the fastener is a rivet.

25. The skate of claim 23, wherein the fastener is molded with one of the facing and the toe cap.

26. The skate of claim 25, wherein the fastener is molded with the facing.

27. The skate of claim 20, wherein the facing is stitchlessly attached to the toe cap.

28. The skate of claim 20, wherein the facing is fastened to the toe cap by a rivet.

29. The skate of claim 28, wherein the rivet is molded with one of the facing and the toe cap.

30. The skate of claim 29, wherein the rivet is molded with the facing.

31. The skate of claim 30, wherein the rivet comprises a projection molded with and projecting from the facing, the toe cap comprises an opening receiving the projection of the rivet, and a head of the rivet secures the facing to the toe cap.

32. The skate of claim 31, wherein the head of the rivet is created by deformation of an end portion of the projection of the rivet upon passage of the projection of the rivet through the opening of the toe cap.

33. The skate of claim 32, wherein the deformation of the end portion of the projection of the rivet includes melting of the end portion of the end projection of the rivet.

34. The skate of claim 20, wherein the facing is ultrasonically welded to the toe cap.

35. The skate of claim 20, wherein the facing is injection molded.

36. The skate of claim 1, wherein the skate is an ice skate and the skating device comprises a blade holder and a blade.

37. A skate comprising a skate boot and a skating device disposed below the skate boot, the skate boot defining a cavity to receive a foot of a user, the skate boot comprising:

an ankle portion configured to receive an ankle of the user;

a heel portion configured to receive a heel of the user's foot;

a medial side portion configured to face a medial side of the user's foot;

a lateral side portion configured to face a lateral side of the user's foot;

a sole portion configured to face a plantar surface of the user's foot; and a toe cap comprising an internal void to receive toes of the user's foot, which include a big toe, an index toe, a middle toe, a ring toe, and a little toe;

wherein: the toe cap comprises a medial part including a medial region of the internal void of the toe cap configured to receive the big toe of the user's foot; the toe cap comprises a lateral part including a lateral region of the internal void of the toe cap configured to receive the little toe of the user's foot; a periphery of the toe cap is shaped such that the medial part of the toe cap is taller than the lateral part of the toe cap; an apex of the medial part of the toe cap is located between a frontmost lacing hole of the skate boot and a front end of the toe cap in a longitudinal direction of the skate boot; and a height of the internal void of the toe cap decreases from the medial region of the internal void of the toe cap to the lateral region of the internal void of the toe cap.

38. A skate comprising a skate boot and a skating device disposed below the skate boot, the skate boot defining a cavity to receive a foot of a user, the skate boot comprising:

an ankle portion configured to receive an ankle of the user;

a heel portion configured to receive a heel of the user's foot;

a medial side portion configured to face a medial side of the user's foot;

a lateral side portion configured to face a lateral side of the user's foot;

a sole portion configured to face a plantar surface of the user's foot; and a toe cap comprising an internal void to receive toes of the user's foot, which include a big toe, an index toe, a middle toe, a ring toe, and a little toe, the toe cap comprising a medial part configured to receive the big toe of the user's foot and a lateral part configured to receive the little toe of the user's foot;

wherein: a periphery of the toe cap is shaped such that the medial part of the toe cap is taller than the lateral part of the toe cap; and an apex of the medial part of the toe cap is located between a frontmost lacing hole of the skate boot and a front end of the toe cap in a longitudinal direction of the skate boot.

39. A skate comprising a skate boot and a skating device disposed below the skate boot, the skate boot defining a cavity to receive a foot of a user, the skate boot comprising:

an ankle portion configured to receive an ankle of the user;

a heel portion configured to receive a heel of the user's foot;

a medial side portion configured to face a medial side of the user's foot;

a lateral side portion configured to face a lateral side of the user's foot;

a sole portion configured to face a plantar surface of the user's foot; and a toe cap comprising an internal void to receive toes of the user's foot, which include a big toe, an index toe, a middle toe, a ring toe, and a little toe, the toe cap comprising a medial part configured to receive the big toe of the user's foot and a lateral part configured to receive the little toe of the user's foot, the toe cap comprising a proximal part configured to receive proximal ends of the toes of the user's foot and a distal part configured to receive distal ends of the toes of the user's foot;

wherein: a periphery of the toe cap is shaped such that the medial part of the toe cap is taller than the lateral part of the toe cap and the proximal part of the toe cap is taller than the distal part of the toe cap; and an apex of the medial part of the toe cap is located between a frontmost lacing hole of the skate boot and a front end of the toe cap in a longitudinal direction of the skate boot.

40. A skate comprising a skate boot and a skating device disposed below the skate boot, the skate boot defining a cavity to receive a foot of a user, the skate boot comprising:

an ankle portion configured to receive an ankle of the user;

a heel portion configured to receive a heel of the user's foot;

a medial side portion configured to face a medial side of the user's foot;

a lateral side portion configured to face a lateral side of the user's foot;

a sole portion configured to face a plantar surface of the user's foot; and a toe cap comprising an internal void to receive toes of the user's foot, which include a big toe, an index toe, a middle toe, a ring toe, and a little toe;

wherein: the toe cap comprises a medial part including a medial region of the internal void of the toe cap configured to receive the big toe of the user's foot; the toe cap comprises a lateral part including a lateral region of the internal void of the toe cap configured to receive the little toe of the user's foot; the lateral region of the internal void of the toe cap is sufficiently smaller than the medial region of the internal void of the toe cap to reduce potential for sliding of the user's toes within the toe cap while skating; a periphery of the toe cap is shaped such that the medial part of the toe cap is taller than the lateral part of the toe cap; and an apex of the medial part of the toe cap is located between a frontmost lacing hole of the skate boot and a front end of the toe cap in a longitudinal direction of the skate boot.

41. A skate comprising a skate boot and a skating device disposed below the skate boot, the skate boot defining a cavity to receive a foot of a user, the skate boot comprising:

an ankle portion configured to receive an ankle of the user;

a heel portion configured to receive a heel of the user's foot;

a medial side portion configured to face a medial side of the user's foot;

a lateral side portion configured to face a lateral side of the user's foot;

a sole portion configured to face a plantar surface of the user's foot; and a toe cap comprising an internal void to receive toes of the user's foot, which include a big toe, an index toe, a middle toe, a ring toe, and a little toe, the toe cap comprising a medial part configured to receive the big toe of the user's foot and a lateral part configured to receive the little toe of the user's foot, the toe cap comprising a lateral attachment portion projecting rearwardly from a proximal end of the toe cap and attached to an overlapping part of the skate boot;

wherein: a periphery of the toe cap is shaped such that the medial part of the toe cap is taller than the lateral part of the toe cap; and an outer side of the lateral attachment portion of the toe cap is covered y the overlapping part of the skate boot.

42. The skate of claim 41, wherein the overlapping part of the skate boot comprises a facing.

43. The skate of claim 41, wherein: the overlapping part of the skate boot is a lateral overlapping part of the skate boot; the toe cap comprises a medial attachment portion projecting rearwardly from the proximal end of the toe cap and attached to a medial overlapping part of the skate boot; and an outer side of the medial attachment portion of the toe cap is covered by the medial overlapping part of the skate boot.

44. The skate of claim 43, wherein: the lateral overlapping part of the skate boot comprises a lateral facing; and the medial overlapping part of the skate boot comprises a medial facing.

* * * * *